US007418108B2

(12) United States Patent
Oser

(10) Patent No.: US 7,418,108 B2
(45) Date of Patent: Aug. 26, 2008

(54) TRANSDUCER FOR TACTILE APPLICATIONS AND APPARATUS INCORPORATING TRANSDUCERS

(75) Inventor: R. Barry Oser, Lafayette, CO (US)

(73) Assignee: So Sound Solutions, LLC, Lafayette, CO (US)

( * ) Notice: Subject to any disclaimer, the term of this patent is extended or adjusted under 35 U.S.C. 154(b) by 668 days.

(21) Appl. No.: 11/061,924

(22) Filed: Feb. 18, 2005

(65) Prior Publication Data

US 2005/0207609 A1 Sep. 22, 2005

Related U.S. Application Data

(60) Provisional application No. 60/546,021, filed on Feb. 19, 2004, provisional application No. 60/652,611, filed on Feb. 14, 2005.

(51) Int. Cl.
*H04R 9/04* (2006.01)
*H04R 1/00* (2006.01)

(52) U.S. Cl. ..... 381/401; 381/412; 381/420

(58) Field of Classification Search ..... 381/326, 381/380, 396, 401, 402, 412, 420; 297/217.3; 601/57

See application file for complete search history.

(56) References Cited

U.S. PATENT DOCUMENTS

| | | | |
|---|---|---|---|
| 2,297,972 | A | 10/1942 | Mills |
| 2,520,172 | A | 8/1950 | Rubinstein |
| 2,821,191 | A | 1/1958 | Pail |
| 2,862,069 | A | 11/1958 | Marchand et al. |
| 3,366,749 | A | 1/1968 | Ries |
| 3,430,007 | A | 2/1969 | Thielen |
| 3,524,027 | A | 8/1970 | Thurston et al. |
| 3,556,088 | A | 1/1971 | Leonardini |
| 3,567,870 | A | 3/1971 | Rivera |
| 3,728,497 | A | 4/1973 | Komatsu |
| 3,880,152 | A | 4/1975 | Nohmura |

(Continued)

FOREIGN PATENT DOCUMENTS

WO WO 03/092441 A1 11/2003

OTHER PUBLICATIONS http://www.colic.com/Company.htm: Sweet Dreems, Inc. (Jul. 29, 2006).

(Continued)

*Primary Examiner*—Brian Ensey
(74) *Attorney, Agent, or Firm*—William W. Cochran; Cochran Freund & Young LLC

(57) ABSTRACT

The disclosed transducer the can transfer an audio signal into a full-spectrum tactile wave over a frequency of 10 Hz-2 KHz. Upper and lower springs of the transducer produce vibrations via a coil/magnet in a manner similar to a conventional speaker, but the transducer uses a novel arrangement of elements, such as two south-to-south coils and carbon fiber springs, so as to produce the vibrations tactilely. The transducers can be tuned for specific applications and can be attached or formed integrally with a support surface. When attached or incorporated into a chair, massage table or other human-support structure, the transducer creates a sonic environment that surrounds and permeates the body with vibration, providing a direct experience of mental desired states. When connected to any full fidelity sound system, a support structure, a full frequency response process promotes a state of relaxation in the listener.

19 Claims, 23 Drawing Sheets

U.S. PATENT DOCUMENTS

| | | | | |
|---|---|---|---|---|
| 4,023,566 | A | | 5/1977 | Martinmaas |
| 4,055,170 | A | | 10/1977 | Nohmura |
| 4,064,376 | A | | 12/1977 | Yamada |
| 4,124,249 | A | | 11/1978 | Abbeloos |
| 4,344,422 | A | | 8/1982 | Immel |
| 4,354,067 | A | | 10/1982 | Yamada et al. |
| 4,635,287 | A | | 1/1987 | Hirano |
| 4,750,208 | A | | 6/1988 | Yamada et al. |
| 4,753,225 | A | | 6/1988 | Vogel |
| 4,813,403 | A | | 3/1989 | Endo |
| 4,841,587 | A | | 6/1989 | Carter et al. |
| 4,951,270 | A | | 8/1990 | Andrews |
| 4,967,871 | A | | 11/1990 | Komatsubara |
| 5,007,410 | A | | 4/1991 | DeLaney |
| 5,086,755 | A | | 2/1992 | Schmid-Eilber |
| 5,097,821 | A | | 3/1992 | Eakin |
| 5,101,810 | A | | 4/1992 | Skille et al. |
| 5,143,055 | A | | 9/1992 | Eakin |
| 5,187,398 | A | | 2/1993 | Stuart et al. |
| 5,216,769 | A | | 6/1993 | Eakin |
| 5,255,327 | A | | 10/1993 | Endo |
| 5,341,054 | A | | 8/1994 | Tal et al. |
| 5,368,359 | A | | 11/1994 | Eakin |
| 5,424,592 | A | | 6/1995 | Bluen et al. |
| 5,437,607 | A | | 8/1995 | Taylor |
| 5,442,710 | A | | 8/1995 | Komatsu |
| 5,473,700 | A | | 12/1995 | Fenner, Jr. |
| 5,624,155 | A | * | 4/1997 | Bluen et al. ..... 297/217.3 |
| 5,784,733 | A | | 7/1998 | Rasamny et al. |
| 5,898,244 | A | | 4/1999 | Kotsianas et al. |
| 6,024,407 | A | | 2/2000 | Eakin |
| 6,120,468 | A | | 9/2000 | Tseng |
| 6,151,402 | A | * | 11/2000 | Azima et al. ..... 381/396 |
| 6,175,981 | B1 | | 1/2001 | Lizama et al. |
| 6,231,497 | B1 | | 5/2001 | Souder |
| 6,502,264 | B1 | | 1/2003 | Clothier et al. |
| 6,659,773 | B2 | | 12/2003 | Roy et al. |
| 6,694,035 | B1 | | 2/2004 | Teicher et al. |
| 6,763,532 | B2 | | 7/2004 | Gardenier et al. |
| 6,785,922 | B2 | | 9/2004 | Bretschger et al. |
| 6,798,888 | B1 | | 9/2004 | Howarth et al. |
| 6,957,454 | B1 | | 10/2005 | Newton |
| 6,984,057 | B1 | | 1/2006 | Rogers |
| 7,081,083 | B2 | | 7/2006 | Ardizzone |
| 7,082,368 | B2 | | 7/2006 | Nickel |
| 7,082,395 | B2 | | 7/2006 | Tosaya et al. |
| 7,082,570 | B1 | | 7/2006 | Von Wiegand et al. |
| 2004/0164971 | A1 | | 8/2004 | Hayward et al. |

OTHER PUBLICATIONS http://www.elixa.com/mattress/massagerplain.htm: Tranqil-Ease Mattress Massager. (Jul. 29, 2006).

http://www.bme.vanderbilt.edu/King/sleepmate.htm: International Award-Winning Student Invention Benefits Newborns; Jamie lawon reeves; The Vanderbilt Register, Jan. 19-25, 1998, p. 4.

http://www.cymatherapy.com/main-ancient-roots.html: Sound-from Ancient Roots to Modern Research. (2004).

http://www.cymatherapy.com/main-new-wave.html: Cymatherapy: A New Wave in Sound Techniques. (2004).

Steven Ashley, Artificial Muscles, Scientific American, Oct. 2003, pp. 53-59.

Shelby Addison, et al.; Sleep Monitoring: Duke University Smart House Pratt School of Engineering; Spring 2005; pp. 1-5.

Rolen-Star Audio Transducers, http://www.rolen-star.com. (Jan. 2005).

Transducer Comparison, www.baudline.com/eric/bass/tactile_report.html. (Jan. 2005).

* cited by examiner

TRANSDUCER FOR TACTILE APPLICATIONS AND APPARATUS INCORPORATING TRANSDUCERS

RELATIONSHIP TO OTHER APPLICATIONS

This application claims the benefit of and incorporates herein by reference U.S. Provisional Application Ser. No. 60/546,021, filed Feb. 19, 2004 and U.S. Provisional Application Ser. No. 60/652,611, entitled "Electronic Muscle Application For Tactile Delivery," filed Feb. 14, 2005.

BACKGROUND OF THE INVENTION

The present invention relates in general to transducers, and in particular to transducers for converting electrical energy into mechanical energy, which are suitable for tactile applications. The present invention also relates to devices that incorporate transducers therein.

Current sound transducers, as incorporated in conventional speakers, are limited in that they cannot easily be tuned for variable frequency applications. They are further limited by requiring a physical support structure. Many conventional transducer designs limit the possible orientation to vertical or horizontal alignments.

Prior art transducers for use in the "tactile" frequency range (10 hz to 2 khz) suffer from a number of these and other limitations. Many applications of these transducers involve attaching the transducer to existing devices (walls, chairs, etc.) that have limited clearance.

One early transducer is disclosed in U.S. Pat. Nos. 3,430,007 and 3,524,027 and is commercially manufactured and sold by Richtech Enterprises as the Rolen-Star Audio Transducer (RSAT). The RSAT measures 1.75"×4" and employs a 2.2 lb. magnet with a 1" edgewound aluminum voice coil. The center of one side of the RSAT is mounted to a panel, such as a wall or ceiling, so as to turn the surface into speaker. Although the voice coil may originally be from a full range 20 hz-20 khz speaker (since this is their advertised range), encasing the coil in a fully-sealed Lexan® plastic casing decreases this range. Furthermore, the mounting surface limits the actual frequency range and its use of a "short throw" voice coil design inside a casing results in very poor bass response. Although pioneering in its day, the RSAT is now considered the cheapest and lowest quality of this type of transducer.

Variations on this type of transducer are disclosed in U.S. Pat. No. 3,567,870 to Riviera and U.S. Pat. No. 3,728,497 to Komatsu.

One other prior art transducer is disclosed in U.S. Pat. No. 5,424,592, assigned to Aura Systems, Inc. Variations of this prior art transducer are marketed by Aura Systems as "Bass Shakers." These "Bass Shakers" can be mounted in any orientation, but the commercial embodiments, such as the Aura AST-2B-4, have a limited frequency response in the 20 hz-80 hz range and are further limited in their application by their size and weight (2.2"×6.2", 3 lbs.). Aura's "Bass Shakers" are also inefficient and tend to get quite hot with extended use, even when cooling fins are used, such as on the Aura AST-2B-4. Yet another problem with the Aura units is that they have a resonant frequency of 45 hz which can easily overpower their phenolic springs.

Another prior art transducer is disclosed in U.S. Pat. No. 5,473,700, assigned to Clark Synthesis. Variations of this prior art transducer are marketed by Clark Synthesis as "Tactile Sound Transducers" or "TSTs." The commercial embodiment of these devices, such as the Clark Synthesis TST429, have an improved frequency range relative to the Aura devices of 5 hz-800 hz, but are limited in their application by being even larger (2.25"×8 ") and have been found by the present inventor to be limited in the orientation that they can be mounted due to the material used in the springs. While the resonant frequency of Clark Synthesis units depends on the material (older units used Lucite "L" acrylic and had a 550 hz resonant frequency whereas newer units have a 65 hz resonant frequency due to use of Cevian® ABS and SAN), in general, they have a flatter frequency response than the Aura units.

A further prior art transducer is disclosed in U.S. Pat. No. 6,659,773, assigned to D-Box Technology Inc. This motion transducer system uses a plurality of synchronized movement generator units for generating small amplitude and low frequency movements in a viewer's chair. A DSP-controller brushless AC motor and a hydraulic piston are used for the generator units.

Additional prior art transducers are disclosed in U.S. Pat. No. 2,297,972 to Mills, U.S. Pat. No. 2,862,069 (Re.26,030) to Marchand et al., U.S. Pat. No. 3,366,749 to Ries, U.S. Pat. No. 4,635,287 to Hirano, and U.S. Pat. No. 4,951,270 to Andrews.

It would therefore be desirable to provide a transducer that overcomes these limitations with the prior art.

Furthermore, stress levels caused by modern society are increasing. Stress is an emotional, physical, and psychological reaction to change. While people often think of stressful events as being "negative," such as loss of a job or relationship, illness or death, they can also be perceived "positive." For example, a promotion, a marriage, or a home purchase can bring a change of status and new responsibility, which leads to stress. Stress is an integral part of life. Whether a stressful experience is a result of major life changes or the accumulative effects of minor everyday events, it is how an individual perceives and reacts to a stressful experience that can create a negative result.

As the result of living in a culture that has advanced more rapidly than its biological nature has progressed, humans still carry primitive instincts from our prehistoric ancestors. A predominate instinctual pattern is the "fight or flight" response. This response is a series of biochemical changes that prepare humans to deal with threats. Primitive man needed quick bursts of energy to fight or flee predators. Today, when society prevents people from fighting or running away, stress triggers a mobilization response that is no longer useful. The dilemma is that people so often mobilize involuntarily for fight or flight, but seldom carry through the process in physical terms. This has very serious consequences for health and well-being.

According to recent American Medical Association statistics: over 45% of adults in the United States suffer from stress-related health problems; 75-90% of all visits to primary care physicians are for stress-related complaints and disorders; every week 112 million people take some form of medication for stress-related symptoms; and on any given day, almost 1 million employees are absent due to stress. In view of this, it is clear that there is a need for improved means for stress reduction.

People often relate the state of relaxation to sleeping, or being otherwise disengaged from responsible activity. In reality, it is a very useful and necessary state when they in the midst of daily activity. Western culture is so oriented to the concept of being physically active and productive that it gives little credibility to activities that don't result in a physical product as their outcome. This leads to an increase in stress levels. Giving individuals permission to choose a state of awareness that is more inner directed than outer allows them to "work smarter, not harder." In the alpha-theta states, people can reduce stress levels, focus, and be centered, not lost in the emotion of the moment. In these states, people can be more creative and self-expressive and bring more clarity to all their ideas.

As the pace and stress of modern life has increased, research into the physical, mental and psychological benefits of stress reduction has also increased. Recently, research has centered on the positive impact of neuro-feedback (EEG Training). The recent availability of powerful personal computers has allowed widespread application of neuro-feedback techniques. Using feedback to increase the deeper, more relaxed brainwave states known as alpha and theta, in turn, facilitates the ability of the subject to understand the feeling of these states of reduced stress and emotionality. Understanding of the feeling allows the subject to access alpha and theta more readily when the states are needed and useful.

This technique relies upon the typical feedback methods of using tones or graphs on the computer screen to gauge access to the states. However, the feedback methods of achieving the desired state often aren't connected to the inner mechanism of reaching them unless the subject spends a lot of time in practice sessions. It would therefore be desirable to have equipment that gives stronger reward system cues when the desired state is being met so as to speed the learning process.

It would also be desirable to have means for stress reduction that does not require any training and practice sessions. One such known method of stress reduction has been to supply a direct experience of the desired state, but supplying these direct experiences (i.e., sitting on a beach or having a full-body massage) are impractical or impossible to supply as often as required.

It would therefore be desirable to have a means and method for addressing stress.

Numerous prior art attempts have been made at providing therapeutic body-support structures such as chairs and tables that provide aural or vibratory stimuli. Examples include U.S. Pat. No. 2,520,172 to Rubinstein, U.S. Pat. No.2,821,191 to Paii, U.S. Pat. No. 3,556,088 to Leonardini, U.S. Pat. Nos. 3,880,152 and 4,055,170 to Nohmura, U.S. Pat. No. 4,023,566 to Martinmaas, U.S. Pat. No. 4,064,376 to Yamada, U.S. Pat. No. 4,124,249 to Abbeloos, U.S. Pat. No. 4,354,067 to Yamada et al., U.S. Pat. No. 4,753,225 to Vogel, U.S. Pat. Nos. 4,813,403 and 5,255,327 to Endo, U.S. Pat. No. 4,967,871 to Komatsubara, U.S. Pat. No. 5,086,755 to Schmid-Eilber, U.S. Pat. No. 5,101,810 to Skille et al., U.S. Pat. No. 5,143,055 to Eakin, and U.S. Pat. No.5,624,155 to Bluen et al. With regard to placement of transducers, the primary teaching of the prior art appears to be that of even distribution of the aural and/or vibratory stimuli.

BRIEF SUMMARY OF THE INVENTION

The present invention overcomes the disadvantages of previously known transducer art by providing transducers, structures using such transducers, and structures with integrated transducers therein. The transducers and structures of the present invention organize vibrations into a meaningful harmonic manner. Additionally, the shape and tension of the transducer springs may be varied to illicit varying frequency and dynamic responses therefrom. Indeed, transducers in accordance with the present invention can easily be tuned for variable frequency applications. They are further do not require a physical support structure and are not limited in orientation to vertical or horizontal alignments.

One advantage of the transducer of the present invention is the ability to transfer an audio signal into a full-spectrum tactile wave. Upper and lower springs of the present transducer produce vibrations via a coil/magnet in a manner similar to a conventional speaker, but use a novel arrangement of elements so as to produce the vibrations tactilely.

Transducers in accordance with the present invention can be tuned for specific applications and can be manufactured as separate units for attachment to conventional supports such as beds, chairs, futons, massage tables, and floors. They can also be manufactured so as to integrally form a support surface with the upper spring of the transducer.

The present invention, especially when incorporated into a chair, massage table or other human-support structure, can create a sonic environment that surrounds and permeates the physical body with vibration, which can provide a most powerful direct experience of mental desired states. When connected to any full fidelity sound system, a support structure in accordance with the present invention can utilize a full frequency response process that promotes a state of relaxation (i.e., inner balance and harmony) in the listener. Test subjects report instant peace when experiencing the subtle inner massage of musical vibration delivered in such a manner, giving the muscles and related ligaments the direct experience of release and warmth.

In a preferred embodiment, the present invention utilizes a unique system incorporating a solid molded carbon fiber support surface as an integral part of a vibration transducer, which serves to evenly spread and balance the vibration for the greatest impact. The fill range of sensation and sound comes through the surface of the support to the body, facilitating access to all brainwave states, from deep relaxation to stimulation and activation. The sensory experience is so pervasive that it gets most of the consciousness's attention over such things as worry, analysis, "to-do" lists and related mental processing.

A body support utilizing the present invention can be connected to a neuro-feedback system and used as the sound source for reinforcing cues. As target states are achieved, the reinforcement is broadcast into the whole body, thus providing a significantly more potent reinforcement so as to promote faster learning. The brain and the body achieve an awareness of how to move into the desired state such that the subject has access to states that match the mood of the moment instead of habitual responses. Bio-neuro-feedback technology can be used in conjunction with the present invention to measure skin conductance, surface skin temperature, heart rate change, muscle tension and brainwave patterns in real time. Measurements can be taken during such sessions, as well as pre- and post-measurements, so as to examine the effects of many variables, such as music type, volume, the previous state of the subject, etc. In such a manner, the present invention can be used to achieve a decreased heart rate, higher skin temperature, lower skin conductance (emotional activation), less general muscle tension, lower blood pressure, improved respiration, and brainwave states shifting from beta to a predominance of alpha and theta waves.

When incorporated into a body support such as a chair, the present invention has also been useful in strengthening the reinforcement of the feedback on the desired state. The improvement achieved by application of the present invention to neuro-feedback seems to lie in the fact that the brain makes a quicker association between the body's responses to its state shifts. This faster learning seems to occur because the enforcement signal being received by the whole body has a stronger impact on the brain. In a preferred embodiment, such a technique uses a low tone with a fairly sharp attack and gentle delay to reinforce the production of lower, slower brainwave frequencies.

BRIEF DESCRIPTION OF THE DRAWINGS

The following detailed description of the preferred embodiments of the present invention can be best understood when read in conjunction with the following drawings, where like structure is indicated with like reference numerals, and in which:

FIG. 9 illustrates.

DETAILED DESCRIPTION OF THE INVENTION

One In the following detailed description of the preferred embodiments, reference is made to the accompanying drawings that form a part hereof, and in which is shown by way of illustration, and not by way of limitation, specific preferred embodiments in which the invention may be practiced. It is to bee understood that other embodiments may be utilized and that changes may be made without departing from the spirit and scope of the present invention.

Figure 1:
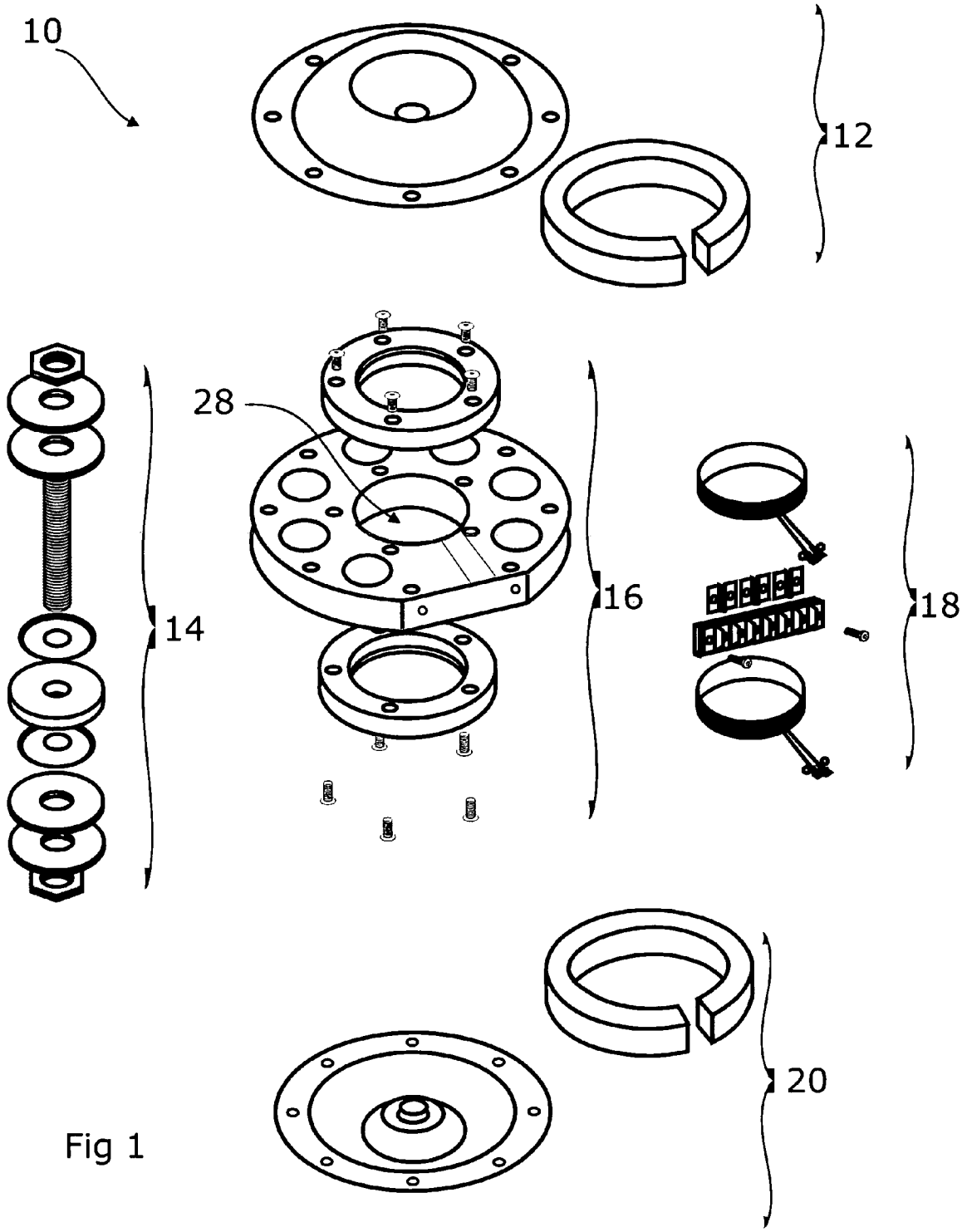
FIG. 1 is an assembly drawing of a transducer according to an embodiment of the present invention.

The Transducer:

Referring to FIG. 1, a transducer 10 is shown in assembly drawing format to illustrate the various components thereof. In general terms, the transducer 10 comprises an upper spring assembly 12, a magnet assembly 14, a main plate assembly 16, a coil assembly 18, and a lower spring assembly 20. When the transducer 10 is assembled, the coil assembly 18 is secured to the main plate assembly 16. The magnet assembly 14 is inserted through the main plate assembly 16 and is secured to the upper and lower spring assemblies 12, 20. The upper and lower spring assemblies are further secured to the main plate assembly 16. Notably, the upper and lower spring assemblies 12, 20 suspend the magnet assembly 14 within the main plate assembly 16 and the coil assembly 18.

Figure 2:
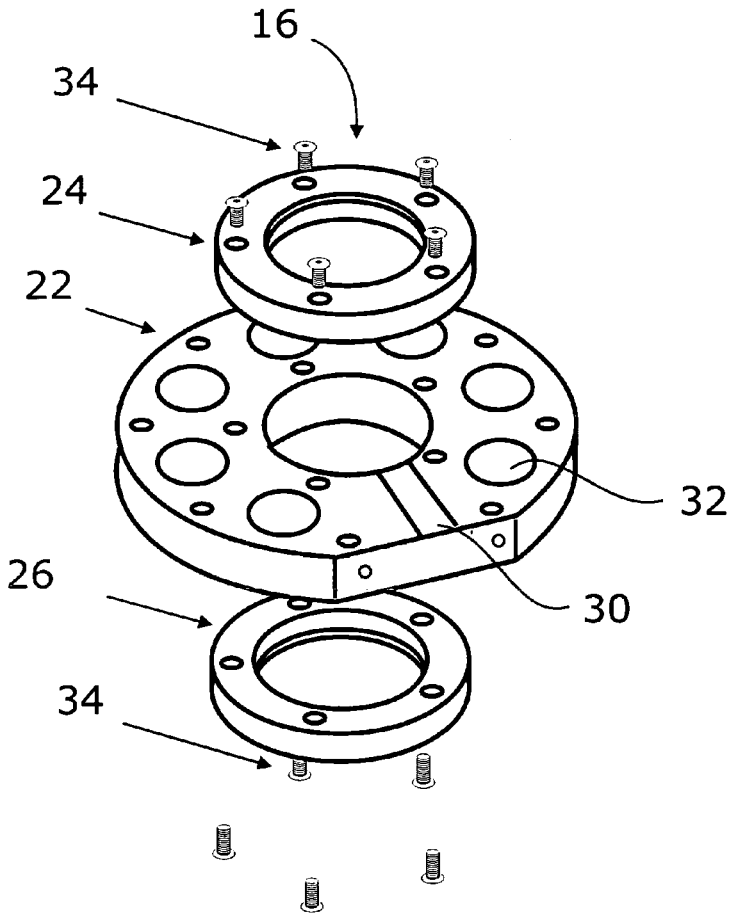
FIG. 2 illustrates the main plate assembly of the present invention.

Referring to FIG. 2, the main plate assembly 16 includes generally, a main plate 22, an upper coil retaining ring 24 and a lower coil retaining ring 26. The main plate 22 is generally cylindrical in shape, having a concentrically centered aperture 28 there through.

The aperture 28 that provides a housing for the magnet assembly 14 and the coil assembly 18 as will be explained in greater detail below. The main plate 22 also includes a passageway 30 (a channel as illustrated), through which an electrical connection is made from an external source such as a power amplifier (not shown) to the coil assembly 18 when the transducer 10 is assembled.

It is anticipated that the transducer 10 may generate heat during operation, depending upon factors such as the amount of power delivered to the transducer 10 and environment in which the transducer 10 is operated. Accordingly, the main plate 22 may also function as a heat sink. In this regard, the main plate 22 is preferably constructed from a material such as aluminum, an aluminum alloy or other heat conductive material, and may optionally include a plurality of features 32 such as through holes to increase the surface area thereof to aid in heat dissipation. The upper and lower coil retaining rings 24, 26 are secured to the main plate 22, such as by using conventional fasteners 34, e.g., screws or rivets, or by bonding to the main plate 22.

Figure 3:
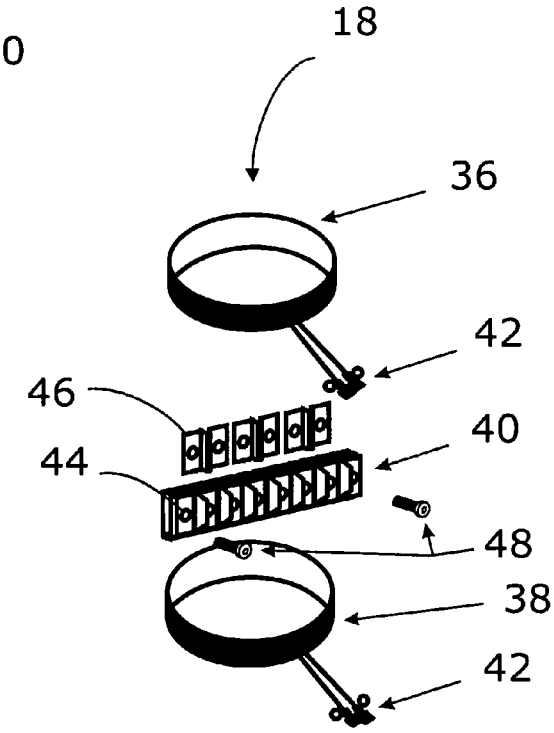
FIG. 3 illustrates a coil assembly according to a first embodiment of the present invention.
Figure 4:
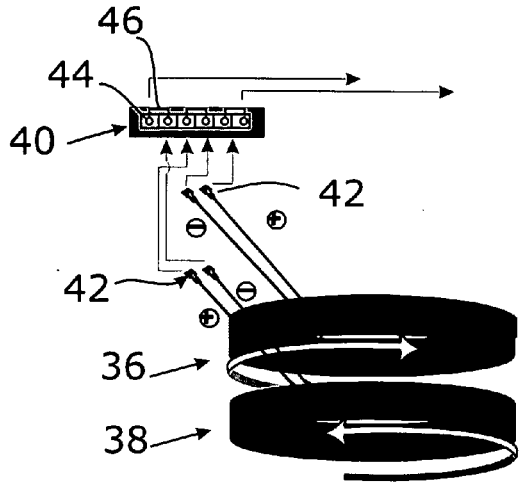
FIG. 4 illustrates a coil assembly according to another embodiment of the present invention.

Referring to FIGS. 3 and 4, the coil assembly 18 includes upper and lower coils 36, 38 and a terminal block 40. As best seen in FIG. 4, the upper and lower coils 36, 38 are electrically coupled together in series such that a "south-to-south" magnetic field relationship is preserved with respect to each other.

The upper and lower coils 36, 38 are connected to the terminal block 40, which connects to an amplifier and audio source (not shown). The amplifier thus supplies power to the upper and lower coils 36, 38 to generate the electromagnetic field. That is, the south poles of each of the upper and lower coils 36, 38 face towards the center of the transducer 10 and the magnet assembly 14. Accordingly, the upper and lower coils 36, 38 are in a mirror placement and create opposite windings. A suitable connection is made from each of the upper and lower coils 36, 38 to the terminal block 40. For example, connectors 42 such as Kliptite Quick Connects model KT35 (available from Marathon® Specialty Products, 13300 Van Camp Road, P.O. Box 468, Bowling Green, Ohio 43402) may be soldered, crimped or otherwise connected to the ends of the wire of each of the upper and lower coils 36, 38.

The upper and lower coils 36, 38 are presently each 2 ohm rated coils and together, they create a 4-ohm coil assembly. However, other ohm ratings, e.g., 8 ohm, could alternatively be used, such as for applications requiring different frequency ratings, different musical usage, different heat ratings or different power amp ratings. The upper and lower coils 36, 38 are comprised of nominal 28 AWG (American Wire Gauge) magnetic wire, an example of which is Bondexe-M wire (available from available from EIS, INC. Electrical Insulation Suppliers of Atlanta, Ga. 30327) or Polybondex® type M wire available from the Essex Magnet Wire of 1601 Wall Street, Fort Wayne, Ind. 46802. In one exemplary construction, the upper and lower coils 36, 38 each contain 65 feet (19.8 meters) in length of wire, and are wrapped in a circular fashion to achieve a coil that has a nominal outside diameter of approximately 1.763 inches (4.478 centimeters) and a nominal height of approximately 0.262 inches (0.665 centimeters).

Other coils could alternatively be arranged in a different fashion along with or instead of the round coils illustrated. For example, a flat spiral coil placed above and below could increase the push and pull of the movement of the magnet assembly. Also, different sizes of magnet wire and/or the size of the upper and lower coils may be changed, such as to accommodate the size of a specific magnet.

The terminal block 40 is coupled to the edge periphery of the main plate 22, and can be implemented using any device suited to communicate electrical power from an external source (not shown) to the transducer 10. In one exemplary configuration, the terminal block 40 includes at least six connection points 44. Three jumpers 46 are positioned so as to electrically short adjacent pairs of connection points 44 on the terminal block 40, which is secured to the main plate 22 using conventional fasteners 48, e.g., a pair of 5-40 head gap screw ⅜ inches (0.95 centimeters) in length, one each on each end portion of the terminal block 40. Other connectors may alternatively be used. However, the six connection points 44 are convenient, as it allows the connection configuration to be changed, such as for testing different combinations of coil leads. In other applications, a different type of terminal block may be used, or the terminal block 40 may be replaced by a jack or speaker attachment. Under such arrangements, the main plate 22 may have to be changed to accommodate the different type of connection to the coil, an example of which is shown in FIG. 5.

Figure 5:
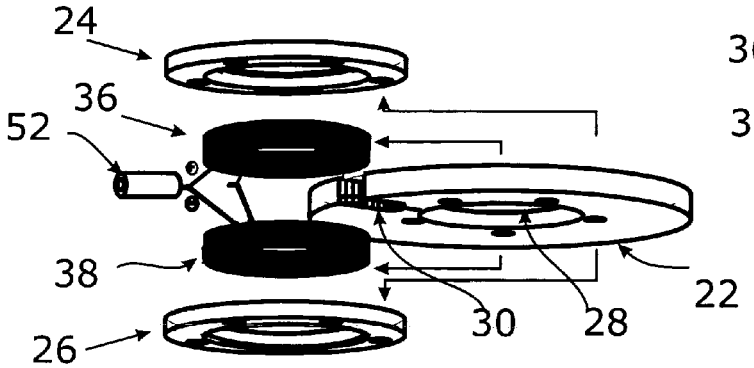
FIG. 5 illustrates an orthogonal view of the assembly of the coil assembly to the plate assembly.
Figure 5:
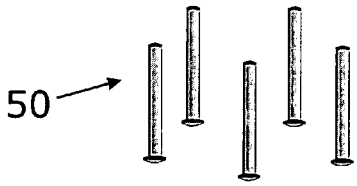
Figure 6:
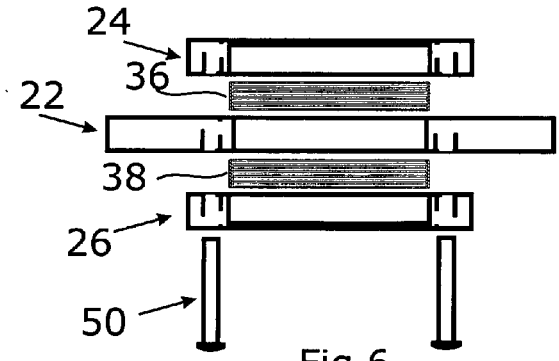
FIG. 6 illustrates a side view of the assembly of the coil assembly to the plate assembly.
Figure 7:
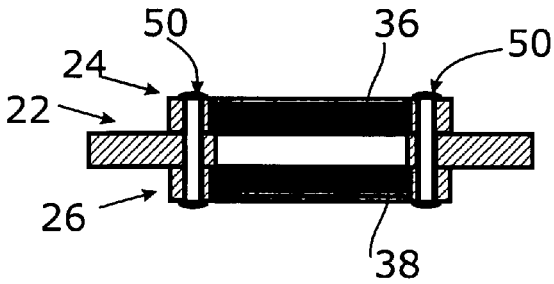
FIG. 7 illustrates the coil assembly installed on the plate assembly.

FIGS. 5-7 show the assembly of the upper and lower coils 36, 38 to the main plate 22. Initially, it can be seen with particular reference to FIG. 5, that fasteners other than screws (as shown in FIG. 1) can be used to secure the upper and lower retaining rings 24, 26 to the main plate 22. For example, as shown, a plurality of (compression) rivets 50 are shown. Also, the channel 30 for passing the electrical connection between the coils and the terminal block may include a portion that extend entirely through the main plate 22, as illustrated by the cutout extending from the periphery of the main plate 22 extending radially inward towards the aperture 28. Also, as shown, the terminal block 40 is replaced by a mono mini jack 52 which is bonded or otherwise fixed into place to illustrate the variety of interconnecting means that may be used with the transducer 10 of the present invention.

As best seen in FIGS. 6 and 7, it can be seen that the upper coil 36 is positioned over the aperture 28 of the main plate 22 so as to be coaxially aligned therewith. The corresponding upper coil retaining ring 24 is positioned over the upper coil 36 and is secured to the main plate 22, such as by screws, rivets or other fasteners. Correspondingly, the lower coil 38 is coaxially aligned with the aperture 28 of the main plate 22 opposite of the upper coil 36. The lower coil 38 is correspondingly held to the main plate 22 by the lower coil retaining ring 26, which is fastened to the main plate 22 using appropriate fasteners as described herein. As best seen in FIG. 7, the upper and lower coils 36, 38 actually rest on the respective opposite surfaces of the main plate 22, and are fixed with respect thereto by the corresponding upper and lower coil retaining rings 24, 26. Subsequent to securing the upper and lower coils 36, 38 to the main plate 22 by the corresponding upper and lower coil retaining rings 24, 26, the assembly may be dipped in epoxy resin and cooked, such as at 150 degrees Fahrenheit (66 degrees Celsius) for approximately 1.5 hours. The epoxy resin bonds the upper and lower coils 36, 38 to the main plate 22 to ensure ohmic contact therebetween so as to draw out the heat efficiently. Different materials may alternatively be used as long as the heat is pulled away from the upper and lower coils 36, 38.

Figure 8:
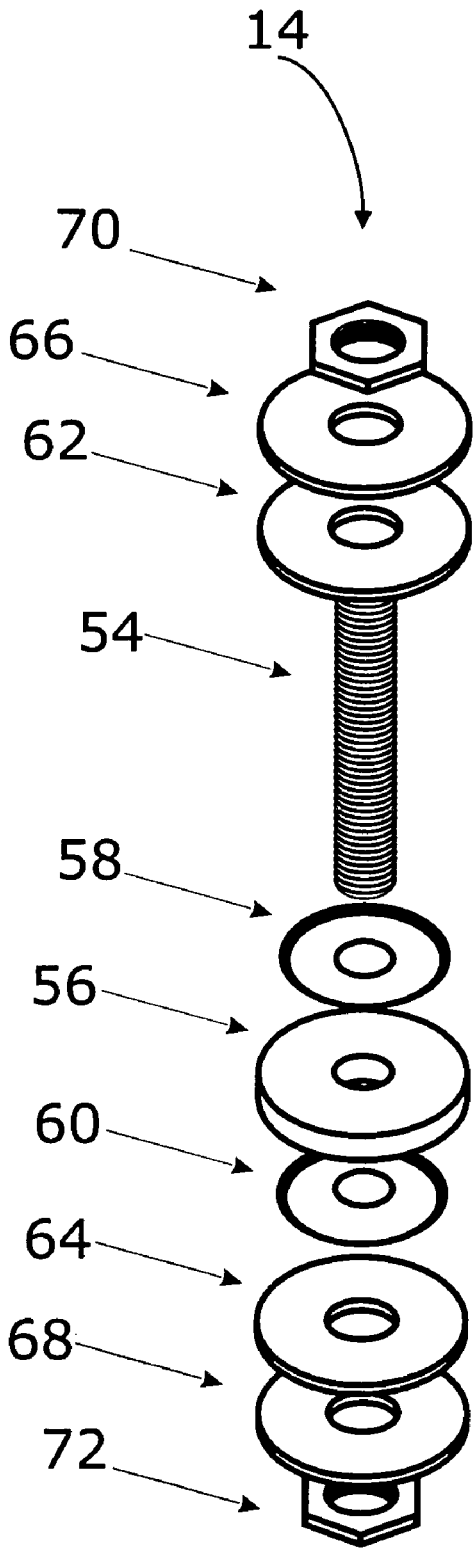
FIG. 8 illustrates the magnet assembly of the present invention.

Referring to FIG. 8, the magnet assembly 14 includes a stud 54 or post upon which the remainder of the magnet assembly is installed. The stud 54 may comprise a brass or stainless steel threaded post, bolt etc. The selection of the specific properties of the stud 54 may depend upon the manner in which the transducer 10 is mounted as will be explained in greater detail herein. An exemplary stud 54 is 1¾ inch (4.45 centimeter) nominal length and ⅜ inch (0.95 centimeter) nominal diameter. A magnet 56 is centered about the stud 54, and a suitable fastening arrangement is provided. For example, as shown, an upper o-ring 58 and a lower o-ring 60 are seated over the stud 54 on opposite sides of the magnet 56. Also provided are upper and lower first washers 62, 64, e.g., rubber washers size #68, upper and lower second washers 66, 68, e.g., ⅜" (0.953 centimeters) or #66 stainless steel, and upper and lower hex nut (am nuts) 70, 72, e.g., 18-8 or #64 stainless steel or other non magnetic material, such as brass, plastic etc.

The magnet 56 has a central hole sufficient to mount on the stud 54 and is held snugly in position by the nipples 84 of the upper and lower springs 74, 78, which also are mounted on stud 54. The magnet 56 comprises a generally flat, ring-shaped permanent magnet having magnetic properties suitable for use in transducers. An exemplary magnet 56 comprises a Neodymium (NdFeB) ring shaped magnet. This type of magnet is commercially available from Yuxiang Magnetic Materials. It is noted that the ring shape is preferable as it allows the desired magnet field (a toroidal magnetic field). Also, the size, strength and weight of the magnet 56 allows the transducer 10 to be small, powerful and to be placed in small spaces not otherwise possible with conventional transducers. The weight and strength of the magnet 56 also allows the transducer 10 to move relatively quickly to respond to fast vibrations. Notably, when accessing relatively faster vibrations, i.e., relatively high frequencies weight is an important factor to the design of the transducer 10.

When the magnet assembly 14 is installed in the transducer 10, the magnet 56 is coaxially aligned with the upper and lower coils 36, 38 and is radially spaced therefrom. That is, there is a gap between the magnet 56 and the upper and lower coils 36. 38. Thus it can be seen that many of the dimensions of the transducer 10 are driven by the type, size and shape of the magnet 56. Conversely, the magnet 56 should be of the correct size so as to snuggly-fit over the stud 54/nipple 84 combination and fit within the aperture 28 of the main plate 22 so as to not contact the coils 36, 38.

Figure 9:
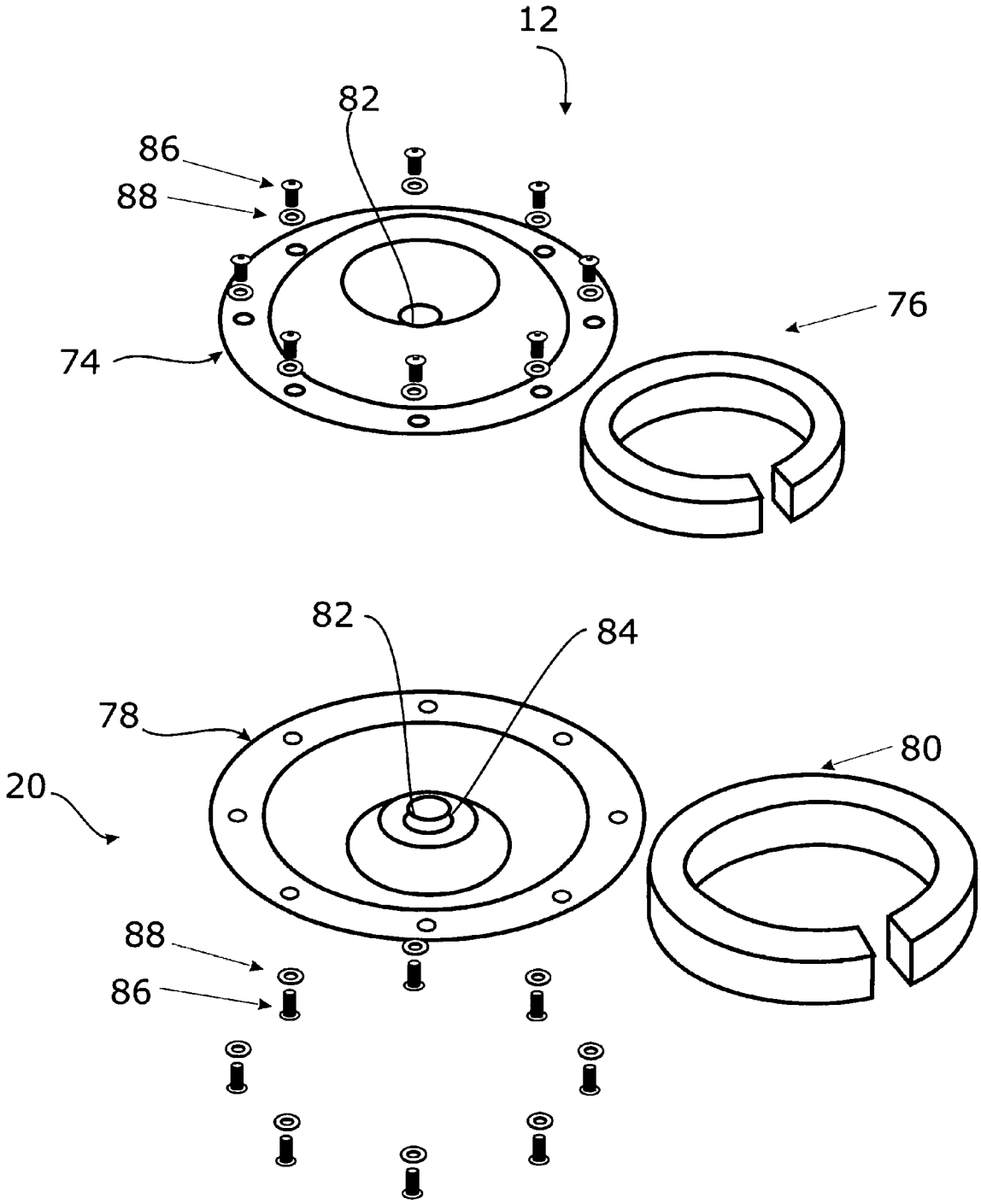
FIG. 9 illustrates the upper and lower spring assemblies of the present invention.
Figure 10:
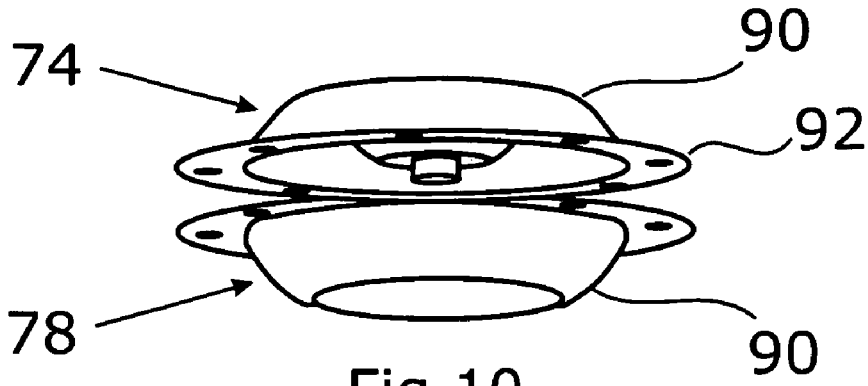
FIG. 10 is an orthogonal view of the upper and lower spring assemblies.
Figure 11:
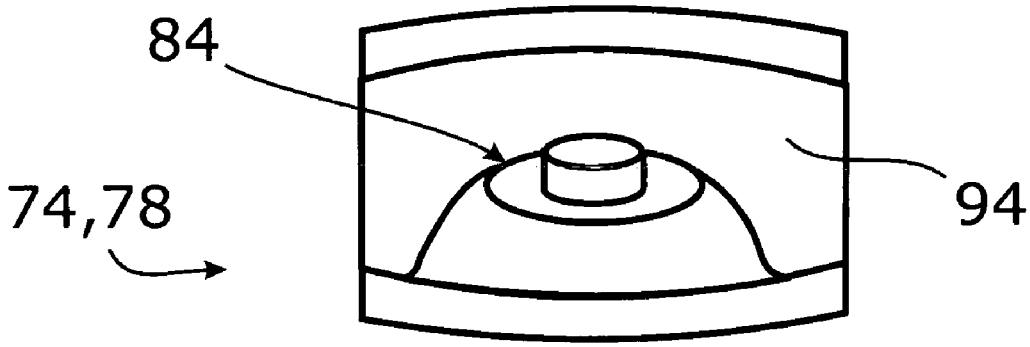
FIG. 11 is an exploded view of the inside of the upper and lower springs.
Figure 12:
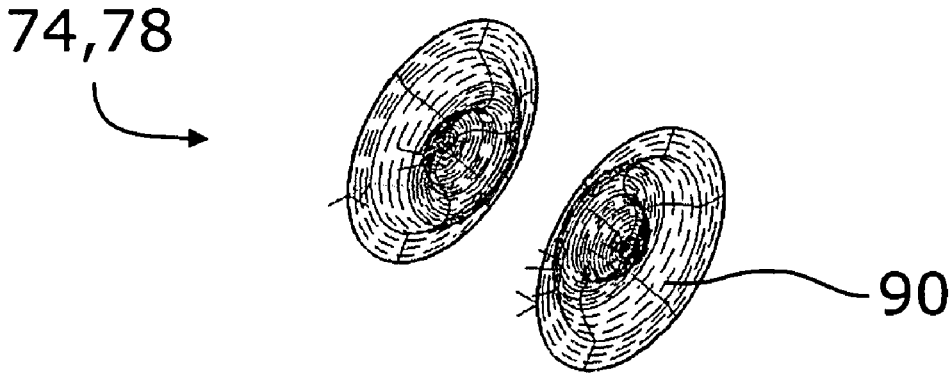
FIG. 12 illustrates the contour of the upper and lower springs.

Several factors affect whether the transducer 10 can accurately track the signal applied thereto. For example, it is noted that the response of the transducer 10 is affected by the weight of the magnet 56. The response of the transducer 10 is also affected by the upper and lower springs. Referring to FIGS. 9, the upper spring assembly 12 includes an upper spring 74, and an upper insulating member 76. Similarly, the lower spring assembly 20 includes a lower spring 78, and a lower insulating member 80. Both the upper and lower springs 74, 78 have a centered through hole 82 and a nipple 84 through which the stud 54 passes through. The nipples 84 are specifically designed so as to hold the magnet 56, such as during assembly and during the working process. The nipples 84 also cooperate to maintain the magnet 56 centered within the aperture 28 of the main plate 22, which promotes efficient operation of the transducer 10. The springs 74, 78 are secured to the main plate using fasteners, e.g., a screw 86 and corresponding washer 88.

Referring to FIGS. 9 through 12, from a top view, each of the upper and lower springs 74, 78 includes a generally circular appearance. From an orthogonal view however, it can be seen that each of the springs 74, 78 defines a surface profile that includes a concentric, ring-shaped protrusion 90 from the surface thereof, which is displaced radially inward of its periphery as shown. The protrusion 90 may be spaced inward of the periphery of the spring 74, 78 to allow a rim 92 for fastening the springs 74, 78 to the main plate 22, such as by using screws 86 and corresponding washers 88, or other fasteners. The spacing of the protrusion 90 may also take advantage of an acoustical property of the transducers according to the present invention as will be described in greater detail below. As such, the upper and lower springs 74, 78 take on the appearance generally similar to a "donut shape" when suitably mated together on the main plate 22.

The particular contour of the surface profile for each of the upper and lower springs 74, 78 allows the transducer 10 to exhibit a specific tonal center and organizes the vibrations produced by the transducer 10 in a manner that is impactful from a tactile perspective as will be described in greater detail herein. The specific size and shape of the upper and lower springs 74, 78 is tailored to allow the transducer 10 to operate over a desired range of the full tactile frequency spectrum. Modifications to the size and shape of either of the upper or lower springs 74, 78 may thus be provided to alter the frequency range and power zones particular to the transducer 10. Notably, the shape and composition of the upper and lower springs 74, 78 may be similar, e.g. mirror image, or different from each other depending upon the intended application.

As noted above, at the center of each spring 74, 78 is a nipple 84 that is designed to hold the magnet 56 generally in the center of the plate 22 and coil assembly 18. The size of the nipple 84 has to be a snug fit to keep the magnet 56 from rattling or moving. A flat surface 94 (best seen in FIG. 11) just above the nipple 84 has a predetermined relationship with the outside of the spring 74, 78 (e.g., the distance of the springs assembled is 0.570 inches or 1.45 centimeters) so that when the outside of the two springs 74, 78 are attached to the main plate 22 the magnet assembly 14 can be tightened or loosened to load or unload the spring tension. The capability of providing variable spring tension allows the transducer 10 to be tuned for variable frequency applications. While not shown, an optional knob may be provided to adjust the tension of the springs in 74, 78 this regard. When the knob is tightened, the "O" rings 58, 60 on either side of the magnet 56 act as a type of spring and mash together adding to the "springiness" in the relationship of the shaped upper and lower springs 74, 78.

As best seen in FIG. 9, seated within each of the upper and lower springs 74, 78 is the corresponding upper and lower insulation 76, 80. The upper and lower insulation 76, 80 can be comprised of any material suitable for use as a damping means for transducers 10, such as neoprene, vinyl, nitrile foam and rubber. The upper and lower insulation 76, 80 may either be disk shaped, or provided as a strip that is wrapped into a generally circular form. To ease assembly, if may be desirable to secure the upper and lower insulation 76, 80 to either the main plate 22 or the corresponding upper or lower spring 74, 78. For example, a suitable adhesive may be used, or alternatively, the upper and lower insulation may be provided with an adhesive pre-applied to a respective surface thereof According to an embodiment of the present invention, a strip of adhesive backed insulation that is nominally ¼ inch (0.64 centimeters) thick by 1¾ inch (4.45 centimeters) wide is used for both the upper and lower insulation 76, 80. Also, the entire spring can be dipped in a insulation substance or poured into to fill the space within each protrusion 90.

To assemble the transducer 10, the stud 54 is inserted through the magnet 56 to form a snug fit with respect thereto. The upper and lower "O"-rings 58, 60, e.g., ⅜ inch (0.95 centimeter) rings are positioned on either side of the magnet 56, and the magnet 56 is seated on the nipple 84 of the lower spring 78. The stud 54 thus passes through the centered through hole 82 in the spring 78. The insulation 80 is also applied to the lower ring 78. The upper coil 36 is positioned about the aperture 28 of the main plate 22, and the upper retaining ring 24 is secured over the aperture 28 and upper coil 36, e.g., using a plurality of fasteners 50, such as rivets or brass flat head screws. Similarly, the lower coil 38 is assembled about the aperture 28 of the main plate 22 opposite of the upper coil 36, and the lower retaining ring 26 is secured to the main plate 22, using a plurality of fasteners 50, such as rivets, brass flat head screws, etc. as described herein. The upper and lower coils 36, 38 are electrically coupled together, and are wired through the channel 30 to the terminal block 40 or other connector. The main plate 22 is seated on top of the lower spring 78. The insulation 76 is provided about the upper spring 74, and the upper spring 74 is seated on top of the main plate 22. The upper and lower springs 74, 78 are secured to the main plate 22 using silicone or gasket material with suitable fasteners 86, 88, such as a 10-32¼ inch (0.64 centimeter) hex head cap screw and rubber, metal or fiber washers. Finally, the first and second washers 62, 64, 66, 68 and corresponding jam nuts 70, 72 are secured to the stud 54.

Depending upon the intended application, an optional bumper may also be provided between the top of the upper spring 74 and the jam nut 70, and/or a bumper may be provided between the lower spring 78 and the corresponding jam nut 72. The bumper is optional and is used to provide isolation in certain applications.

The upper and lower springs 74, 78 may be constructed from a carbon fiber and Kevlar® aramid fiber formulation, although other materials such as wood, metal and other compositions may alternatively be used. Such carbon fiber/Kevlar aramid material is originally manufactured by Hexcel, Fabric Development and Dupont.

In a preferred embodiment, the carbon fiber/Kevlar aramid specification is: Yarn type:

T300B-3K-40B, 1420 Denier, Kevlar 49, T965, Weave: 2×2 Twill, Count: 13×13.6, Weight: 5.62 osy, Thickness: 0.0125". The carbon fiber/Kevlar aramid combination provides a structurally strong spring casing that enables the transducer 10 to deliver tactile force peaks sufficient to cover a broad range of applications. The exact composition of the carbon fiber and/or Kevlar aramid will depend upon the requirements of the particular application. For example, carbon compositions are generally stiff and resonate and the Kevlar aramid fiber is pliable and has stretchable strength. When delivering vibrations into a person, e.g., through a surface where the recipient of the vibrations is laying, the nature of vibration is better received if the transducer is more in tune to the behavior of the body. The carbon fiber and Kevlar combination allow springs to be constructed to act in such a way to tighten when needed and soften when needed very much like our body systems. Other transducers with plastic or differently shaped materials have been found by the inventor to "beat" the vibration into the body in a less effective manner.

As suggested above, the vibrational information conveyed by the transducer 10 can be "tuned" in a number of different ways. For example, the use of the "O" rings 58, 60 (best seen in FIG. 8) allows the upper and lower springs 74, 78 to be tightened or loosened to load the springs 74, 78 differently. Adjustment of this "loading" allows control over the tonal response e.g., by tightening or loosening the upper and lower springs 74, 78, the low frequencies can be tailored. To facilitate easy adjustment thereto, a knob (not shown) could be attached to the magnet assembly 14, e.g., to the upper and lower hex nut (jam nuts) 70, 72, to allow customization of the spring tension.

Figure 13:
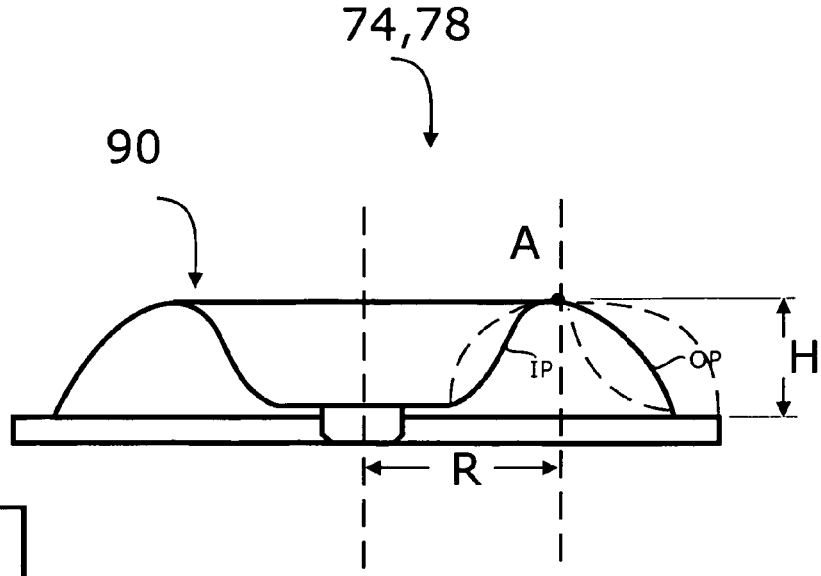
FIG. 13 is a schematic illustration showing different parameters of the spring geometry according to the present invention.

Also, the transducer 10 can be tuned by altering the size and surface contours of the springs 74, 78 to target frequency tones. The following discussion applies to both the upper and lower springs 74, 78. Referring to FIG. 13, a cross-sectional view of a spring 74, 78 is illustrated. The spring 74, 78 include at least one surface contour, a protrusion 90 as shown. The present inventor has discovered that curving the surface of the spring 74, 78 (or of a structure coupled to the transducer 10 of the present invention) produces tension and pitch. As illustrated, the surface contour is a raised protrusion 90 that extends concentrically about the center of the spring. By selecting parameters such as the radius R from the center of the spring to the apex A of the contour, the height H of the contour, the outer profile OP of the curve from outer edge of the spring to the apex A of the contour, and the inner profile IP of the curve from the inner portion of the spring 44 to the apex A of the contour, frequency tones can be targeted. For example, as shown, the outer profile OP is slightly convex, and the inner profile IP is slightly concave. However, in practice, each of the inner and outer profiles IP, OP can be concave, convex, linear or follow any other curvilinear pattern.

Also, while currently a concentric protrusion is preferred, it will be appreciated that other approaches may be implemented within the spirit of the present invention. For example, the protrusion 90 may form an elliptical pattern about the center of the spring 74, 78. Also, it shall be observed that the upper and lower springs 74, 78 may be mirror image of one another, or the upper and lower springs 74, 78 may take on independent characteristics including the positioning and profiles that characterize their respective contours. Still further, while shown with only a single protrusion 90 for purposes of clarity, it is to be understood that any number of contours may be implemented. Thus the design of the springs 74, 78 allows the transducer 10 to produce a full range or targeted range response depending upon the particular design.

Referring to FIGS. 14-18, as an example, a spring 74, 78 is designed having a profile that conforms to a set of phi ratios to shape the spring 74, 78, expressed as:

$$\frac{1+\sqrt{5}}{2}=\phi$$

Figure 14:
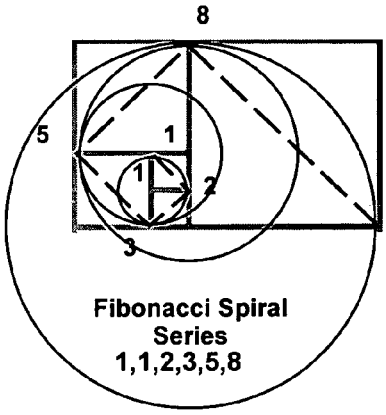
FIG. 14 illustrates the Fibonacci spiral used to design the springs according to the present invention.

The distance from the edge of the spring 74, 78 to the center of the curved surface profile has a circular pattern size and shape due to the phi or the Fibonacci series of numbers arranged to create a spiral. FIG. 14 illustrates a typical expression of the Fibonacci spiral series. It has be found through experiments that general conformance to this nominal shape in a donut fashion, given these phi relationships, allows control over the tonal shape of the spring 74, 78. That is, strict conformance to the "ideal" design is not required so long as the general shape is followed. Moreover, the spring 74, 78 has multiple tones that are inherently organized in a harmonic relationship that is natural to the laws of harmonics.

Figure 15:
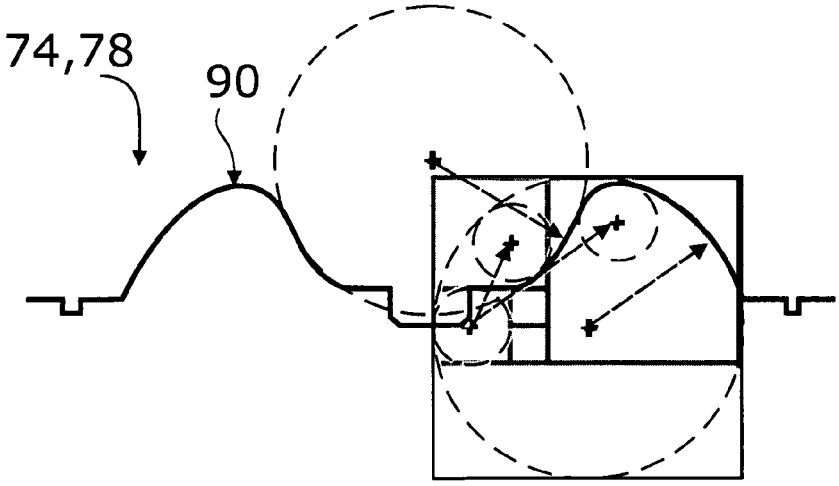
FIG. 15 illustrates one exemplary way to apply Fibonacci ratios to the spring geometry according to the present invention.
Figure 16:
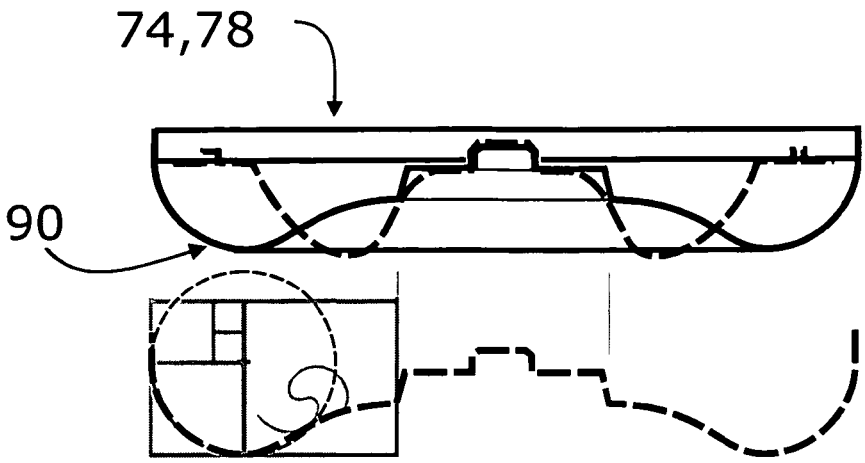
FIG. 16 illustrates one exemplary way to apply Fibonacci ratios to the spring geometry according to the present invention.
Figure 17:
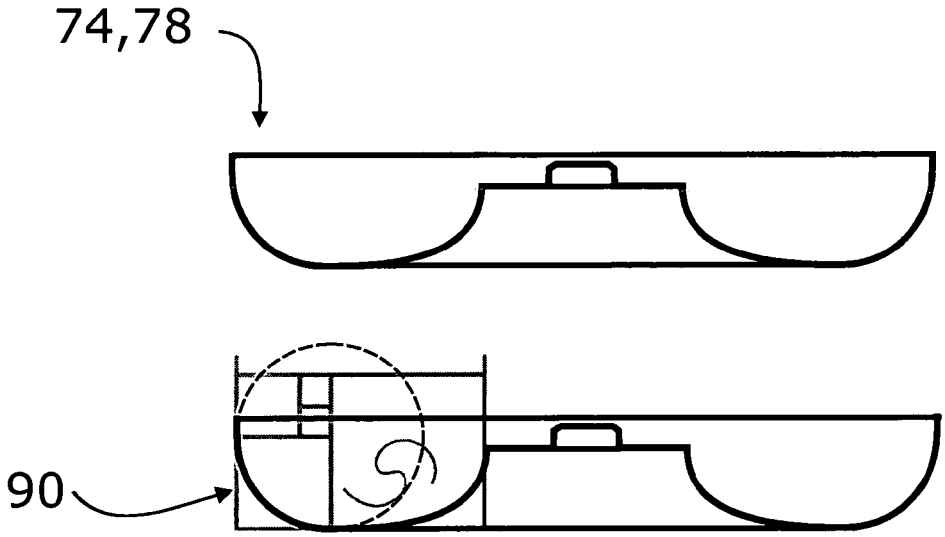
FIG. 17 illustrates one exemplary way to apply Fibonacci ratios to the spring geometry according to the present invention.
Figure 18:
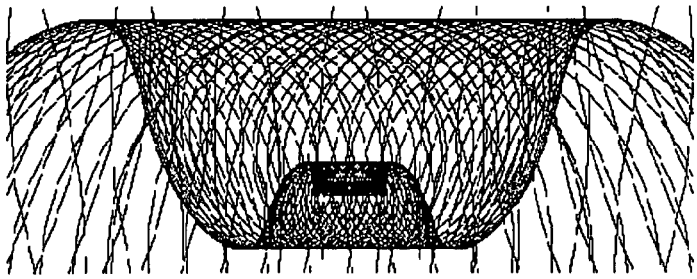
FIG. 18 illustrates a fractal phi ratio embedded wave used to construct a spring according to the present invention.

Notably, the shapes used herein elicit specific frequencies. By controlling the size, relative position and shape of the profile, and by controlling the material, including the thickness thereof, different tonal vibrations are created when the spring 74, 78 is resonated. Typically, music is used as the "information" that is delivered through these transducers. It has been found that both music and many aspects of the human body can be expressed in terms of the Fibonacci sequence. Moreover, experiments by the present inventor have shown that the vibrational energy produced by the transducer 10 is efficient when the shape of the springs 74, 78 is also related in some regard to the Fibonacci sequence. FIGS. 15-17 illustrate several illustrative approaches to applying the Fibonacci sequence to the design of a spring 74, 78. FIG. 18 illustrates an exemplary fractal phi ratio embedded wave to illustrate one example of a spring design. Each of the approaches illustrated in FIGS. 15-17 may have different frequency responses due the differences in the spring geometry.

Figure 19:
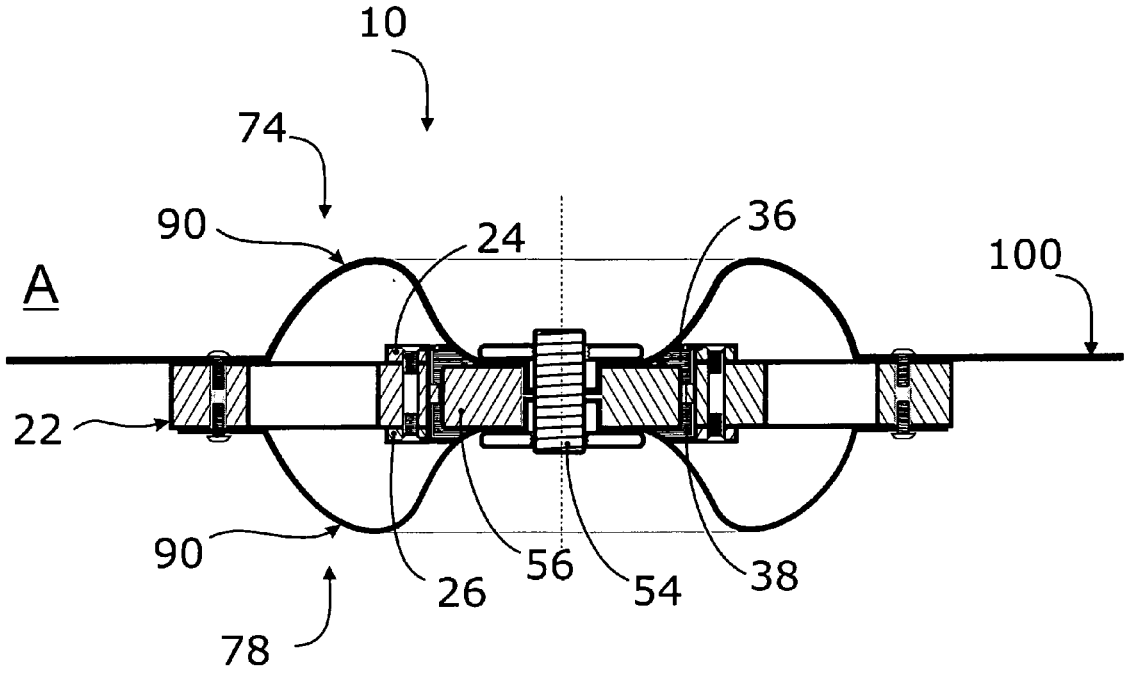
FIG. 19 is a cross sectional view of an exemplary transducer for producing relatively lower frequencies according to an embodiment of the present invention.
Figure 20:
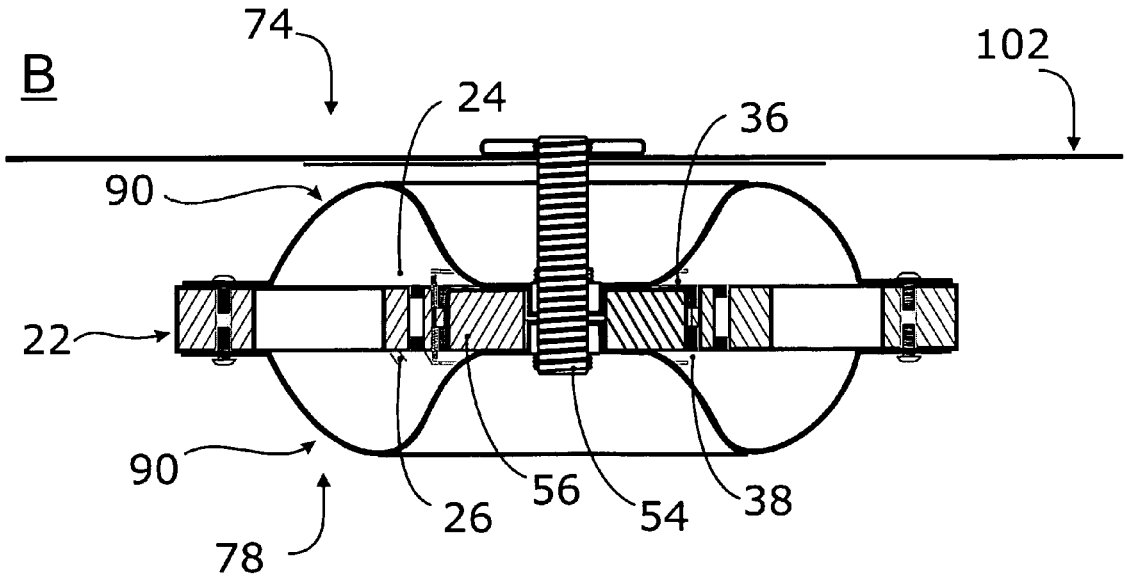
FIG. 20 is a cross sectional view of an exemplary transducer for producing relatively higher frequencies according to an embodiment of the present invention.

By shaping the springs as set out above, the springs elicit not one tone but three. These three tones are harmonically related and can be expressed using standard musical nomenclature as the root, the third and the fifth, and their corresponding overtones. That is, the fundamental tone is separated upwardly in frequency by an octave and a fifth from the next tone, which is the fifth. The next tone elicited is the third, which is a expressed as a $6^{th}$ above the fifth (again using standard musical nomenclature). The relationship of these three tones, in this way, is present in the shaping of the spring when implementing phi ratios into the design of the surface profile. Using springs 74, 78 that have multiple tones in the chordal arrangement, allows the tactile delivery to be uniquely sympathetic to the manner in which the body and mind of a person in contact with the transducer 10 perceive its effects. FIGS. 19 and 20 illustrate cross-sections of the transducer 10 to illustrate a few exemplary spring designs. The spring design in FIG. 19 allows the transducer 10 to operate in relatively low frequencies where the spring design in FIG. 20 makes the transducer suitable for a frequency response that is relatively higher than that shown in FIG. 19.

As shown, the magnet 56 is coupled to a surface 102. Note that the magnet 56 is snuggly secured to the stud 54 and that the stud 54 is attached to a surface. Under this arrangement, the upper and lower coils 36, 38 and main plate 22 move in response to an electrical signal (and not the magnet 56). This is in contrast to the typical approach employed by transducers 10 that typically move the magnet. Alternatively, speaker designs typically move a light coil. However, in the present invention, the upper and lower coils 36, 38 are embedded in the main plate 22, and the main plate 22 adds a significant amount of weight to the moving parts. It should be noted that it may be desirable in certain circumstances to isolate the surface 102 from the remainder of the supporting structure. This has the effect of keeping the resonance caused by the vibrating transducer 10 maintained local to the surface 102.

Due, at least in part to the structure of the springs 74, 78, the transducer 10 is capable of tactile operation within a frequency range of approximately 20 hz to 2 Khz. Moreover, the transducer 10 is designed to maintain balance and operate irrespective of orientation and is thus suited for applications that require the transducer 10 to be installed at angles other than alignment to the vertical or horizontal. It is noted that some conventional transducer designs limit the possible orientation. Also, while typical transducers 10 require a rigid attachment to a sounding board such as a wall or floor or other surface, the transducer 10 of the present invention need not be mounted at all. Rather, the transducer 10 can be handheld, mounted to a handle, or embedded in foam to produce a vibration. For example, the transducer 10 can be operated as a hand held vibrator that functions as a programmable frequency generator that can be connected to any audio source compared to the mechanical motor vibrators typically encountered.

Figure 21:
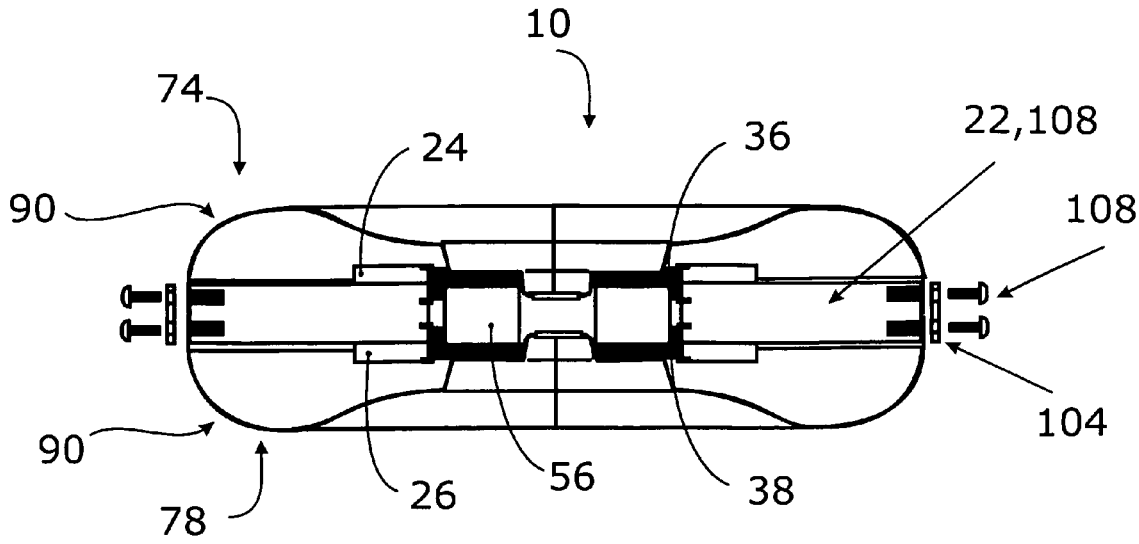
FIG. 21 is a cross sectional view of an exemplary transducer for producing relatively lower frequencies according to another embodiment of the present invention.
Figure 22:
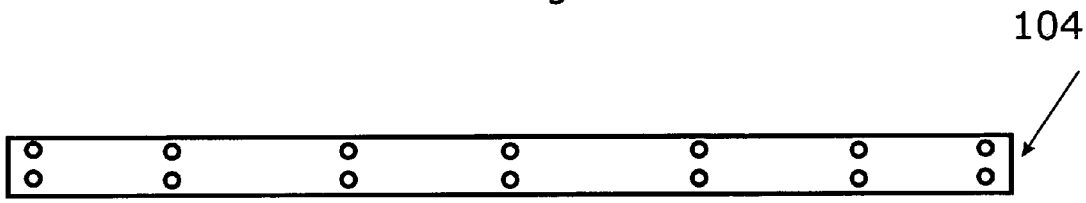
FIG. 22 illustrates a strap for connecting the upper and lower springs of the transducer shown in FIG. 21.
Figure 23:
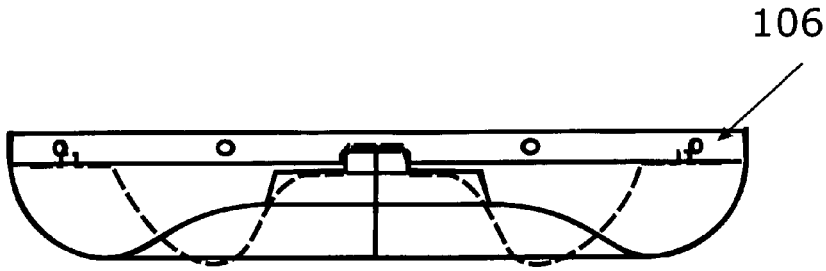
FIG. 23 illustrates the upper and lower springs of the transducer of FIG. 21 illustrating the holes for mounting the springs to the strap shown in FIG. 22 according to an embodiment of the present invention.

Referring generally to FIGS. 21-23, a transducer 10 according to another embodiment of the present invention is illustrated. The transducer 10 is similar to the transducer 10 discussed with reference to FIG. 1. However, an aluminum strap 104 is wrapped about the main plate 22. Notably, the upper and lower springs 74, 78 include a plurality of apertures 106 located around the periphery thereof. The strap 104 is bent into a ring shape and the upper and lower springs 74, 78 are fastened thereto using fasteners 108, e.g. screws. Comparing FIGS. 21-23 with FIG. 9, it can be seen that in FIG. 9, the contour or protrusion 90 of the springs 74, 78 is inset from the outer edge thereof and arcs relatively high. This particular configuration allows the transducer to target a relatively higher tonal center. Contrasting FIG. 9 to FIGS. 21-23, it can be seen that the protrusion 90 is shifted outward toward the edge periphery of the springs 74, 78. Also, note that the protrusion 90 is more rounded and less abrupt than that shown in FIG. 9. This structure allows the transducer 10 shown in FIGS. 21-23 to target a lower tonal center, e.g., 20-800hz range.

Figure 24:
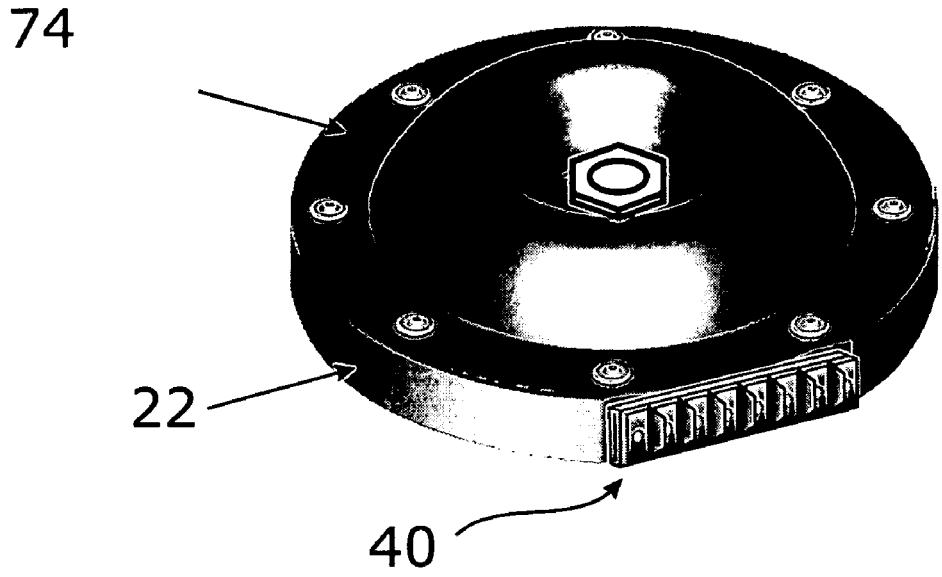
FIG. 24 is an orthographic view of an assembled transducer according to an embodiment of the present invention.
Figure 25:
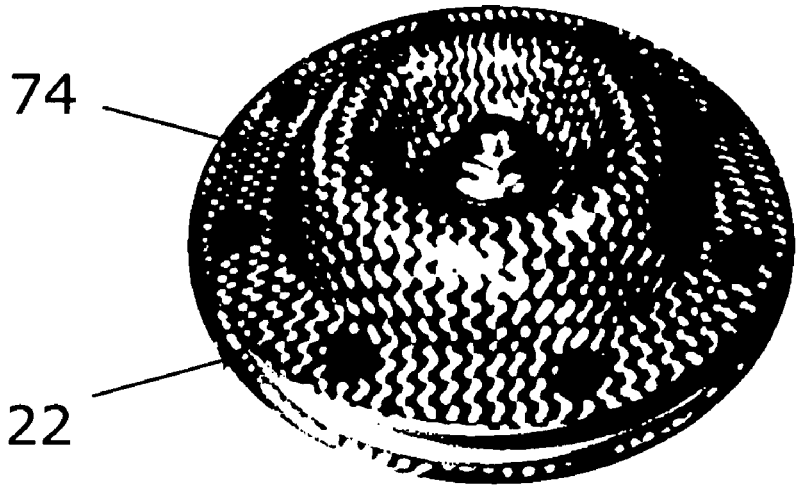
FIG. 25 is an orthographic view of an assembled transducer illustrating the structural appearance of carbon/Kevlar® according to an embodiment of the present invention.
Figure 26:
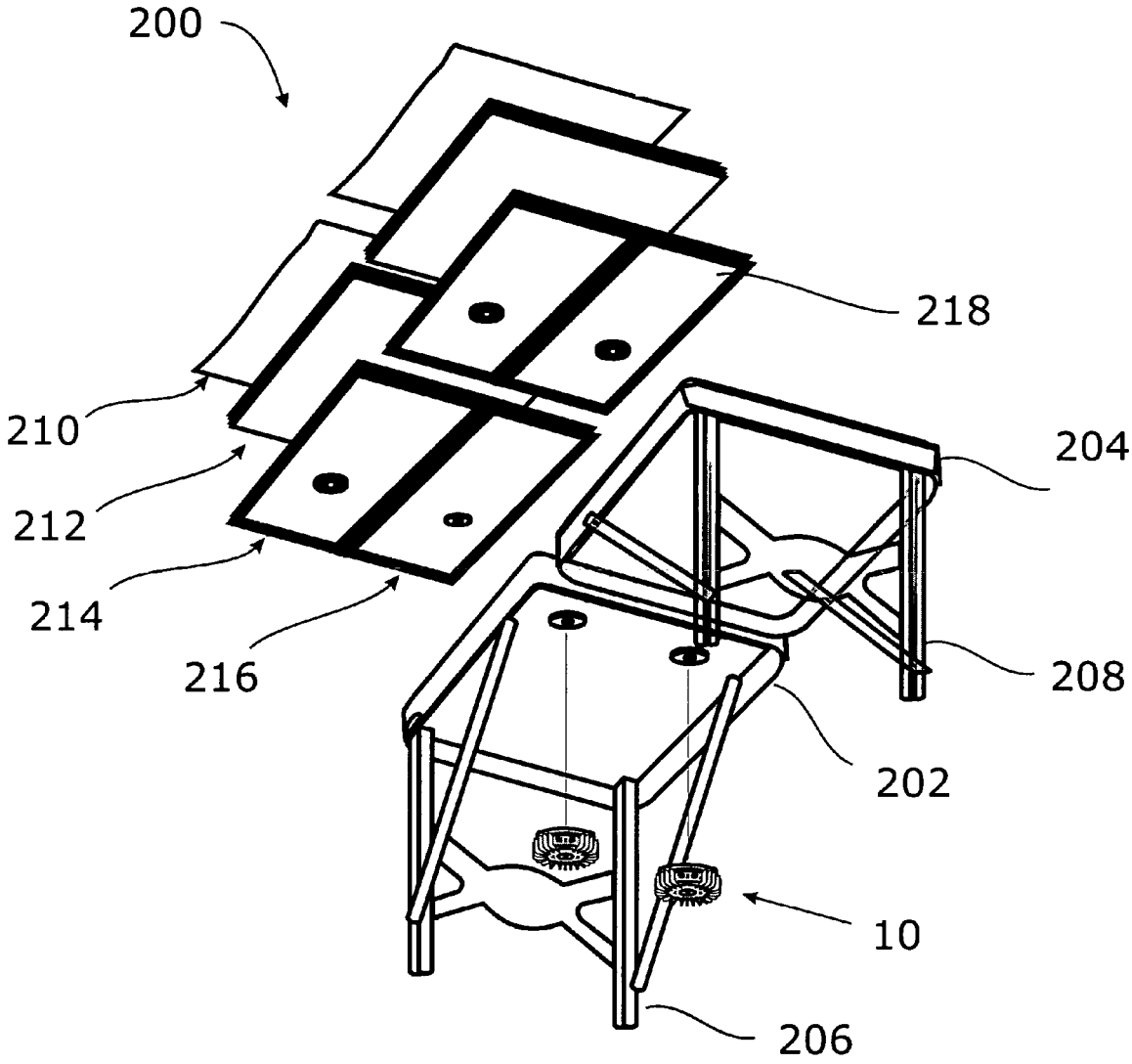
FIG. 26 is an assembly drawing of a structure including an integral transducer according to an embodiment of the present invention.

FIG. 24 illustrates a spring coupled to the main plate illustrating the connection of the terminal block to the main plate. FIG. 25 illustrates the spring showing the texture of a carbon fiber and Kevlar composition.

Structures Incorporating Transducers

Sound Tables/Floors/Pads/Chairs

As noted above, the vibrational information conveyed by the transducer 10 can be "tuned" by altering the size and surface contours on the springs to target specific frequency tones. It is also possible to integrate the concepts of the transducer 10 described above into structures so that the transducer becomes an integral part of the structure itself. In particular, at least one surface thereof effectively becomes the springs of the transducer.

Referring generally to FIGS. 26-31, an exemplary apparatus 200, a folding table is illustrated. The table may be used as a massage table or for other purposes where it may be desirable to sit or otherwise rest upon a surface thereof, such as for rehabilitation, therapeutic treatment, dental chair etc. The table 200 includes generally, a first table section 202 hingedly connected to a second table section 204. A first pair of folding legs 206 is secured to the bottom side of the first table section 202 and a second pair of folding legs 208 is secured to the bottom side of the second table section 204. The first and second sections 202, 204 each include generally, an upholstery or other layer 210, a foam padding layer 212, and a panel assembly 214. Each panel assembly 214 includes two transducer assemblies 216, 218 as shown. Other arrangements are possible within the spirit of the present invention, however. For example, the panels 214 may be divided up into any number of individual transducer assemblies.

Figure 27:
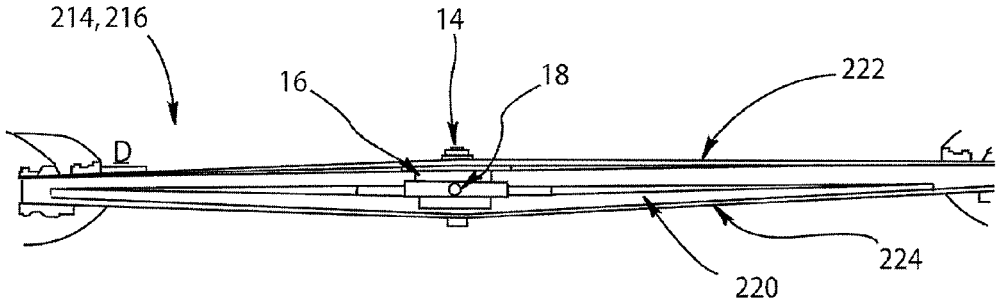
FIG. 27 is a side view of a transducer integrated into the structure of FIG. 26.

As best seen in FIG. 27, what would otherwise be a typical panel of the table 200 actually define the transducer itself. In addition to the transducer assemblies, optional additional transducers may be mounted to the panels 214. For example, as shown, two transducers 10 are mounted to a select one of the two panel assemblies 214. The additional transducers 10 may be provided to target specific frequency or dynamic ranges and can be positioned to achieve a desired effect. For example, the transducers 10 may be provided to specifically target lower frequencies. Each of the transducer assemblies 214, 216, and each additional optional transducer 10 is connected to a power amplifier and audio source (not shown), which provides the energy to the table 200. It should be pointed out here that the table is set up to create stereo or multi-channel operation. Typical transducer applications are limited to mono or single channel response. However, because the transducers of the present invention can be tuned as set out herein, multi-channel applications now become practical.

The structure that would otherwise be present in a typical implementation of the apparatus is replaced by corresponding transducer assemblies 216, 218. For example, a typical table would include a panel (i.e., horizontal support surface), which is replaced in the present invention with transducer assemblies 214, 216. It should be noted that the transducer assemblies 216, 218 are not merely a transducer bolted to a panel or other surface. Rather, the panel (or any surface) defines a working component (the springs or spring) of the transducer as described below.

The transducer assemblies 216, 218 are essentially the same construction as that described more fully herein, except that the springs are replaced with a modified version of the structure of the apparatus. Referring to FIG. 27, the transducer assemblies 216, 218 include generally, a magnet assembly 14, a main plate assembly 16, a coil assembly 18, an optional internal support member 220, and a pair of springs 222, 224. The magnet assembly 14, main plate assembly 16 and coil assembly 18 essentially comprise the transducer 10 discussed above with reference to FIGS. 1-25 without the upper and lower spring assemblies 12, 20. The transducer assembly 214, 216, including the top spring 222, serves the same functions as the structure it replaces. That is, the transducer assembly 214, 216 may be load bearing, aesthetically or ornately decorated, or perform whatever functions the original structure performed.

Figure 28:
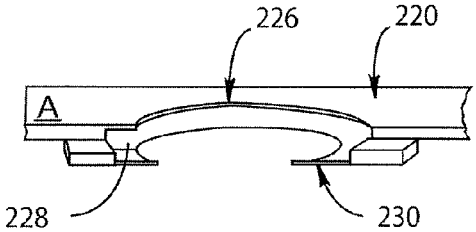
FIG. 28 is an exploded view of the support for holding the magnet and plate assembly according to an embodiment of the present invention.
Figure 29:
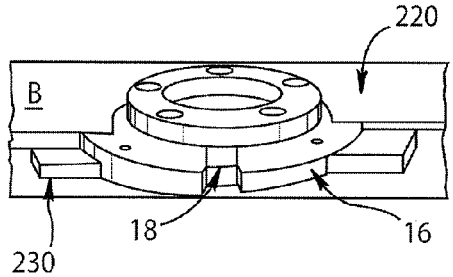
FIG. 29 is an exploded view of the main plate assembly, coil assembly and magnet assembly counted to the support shown in FIG. 28.

The internal support member 220 provides support to the apparatus and serves as a seat for holding the main plate assembly 16. As best seen in FIG. 28, the internal support member 220 includes a top support surface 226, a plate receiving slot 228, and a bottom support surface 230. The plate receiving slot 228 is dimensioned to receive the main plate assembly 16 therein. The top support surface 226 engages the top surface of the main plate assembly 16 and the bottom support surface 230 engages the bottom surface of the main plate assembly 16 to provide support thereto. The internal support member 220 may comprise a single layer of material that has been routed out to the desired shape, or alternatively, the internal support member may comprise two or more layers stacked together. Referring to FIG. 29, a cutaway view illustrates the main plate assembly 16 and coil assembly 18 installed in the internal support member 220.

Figure 30:
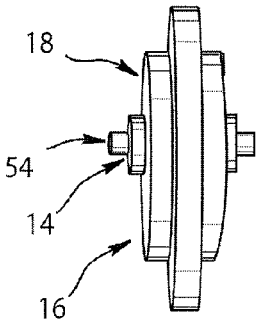
FIG. 30 illustrates the transducer without the springs attached according to an embodiment of the present invention.
Figure 31:
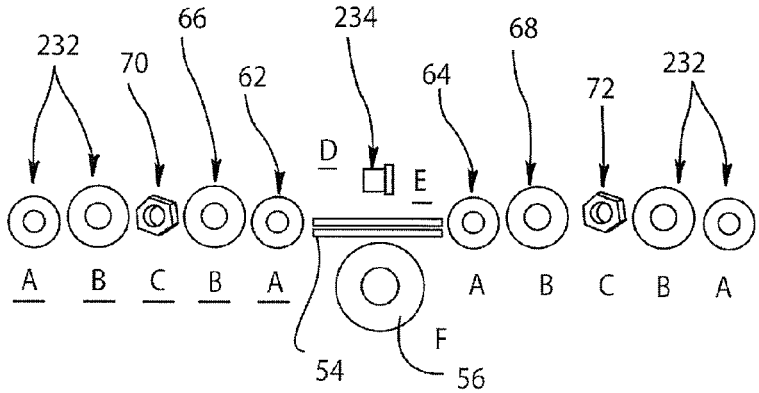
FIG. 31 is an assembly view of the magnet assembly in the transducer of FIGS. 26-30.

Referring to FIG. 30, a portion of the transducer is illustrated showing the magnet assembly 14 and the coil assembly 18 coupled to the main plate assembly 16. Referring to FIG. 31, it can be seen that the main plate assembly 16 may require an additional set of washers 232 and a spacer 234 which may optionally be used to position the transducer. Also, it is noted that the top of the stud 54 may optionally be configured so as to be flush with the top of the upper spring 222. When assembled, the upper and lower springs 222, 224 produce the vibration. This produces significantly more responsive results than simply mechanically attaching a transducer to an existing panel. This can be seen because the original panel, which may not convey vibrations accurately, is replaced with a material that performs the same functional aspects of the replaced panel, but that also is further optimized for use as a spring of a transducer as described above.

Figure 32:
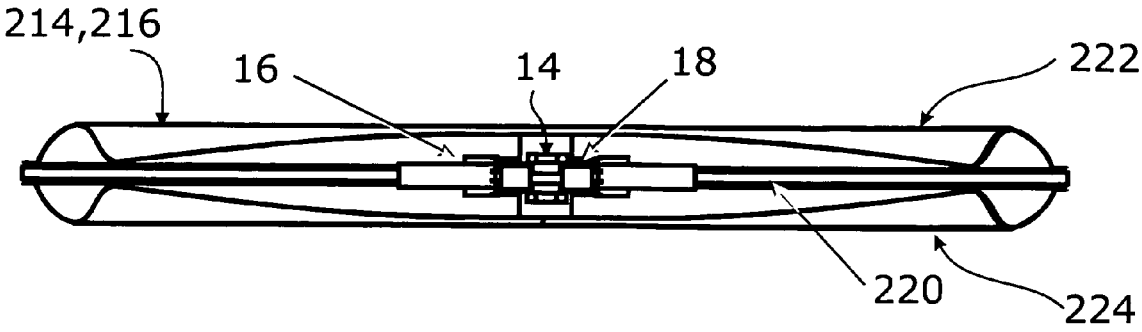
FIG. 32 is a cross sectional view of the transducer integrated into a structure of FIG. 26.
Figure 33:
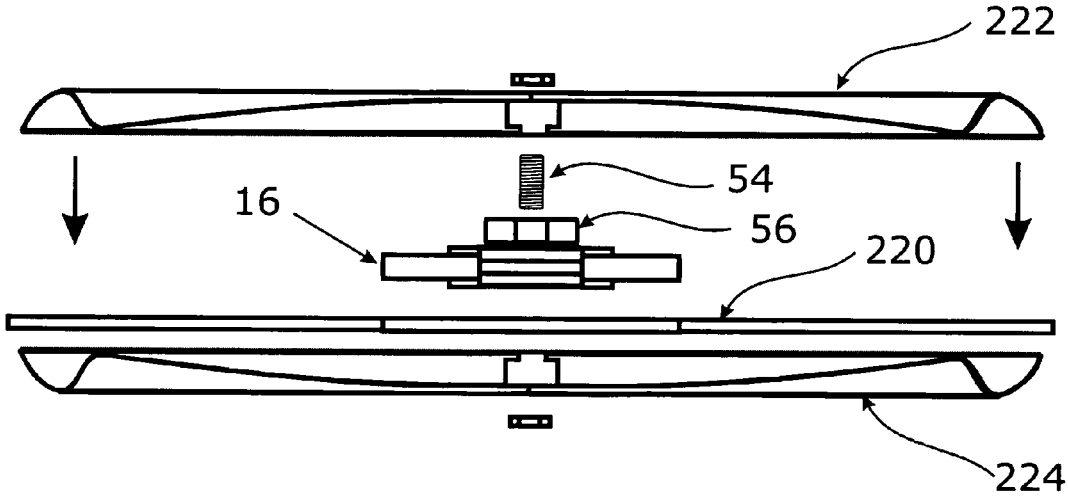
FIG. 33 is an assembly drawing of the transducer of FIG. 32.
Figure 34:
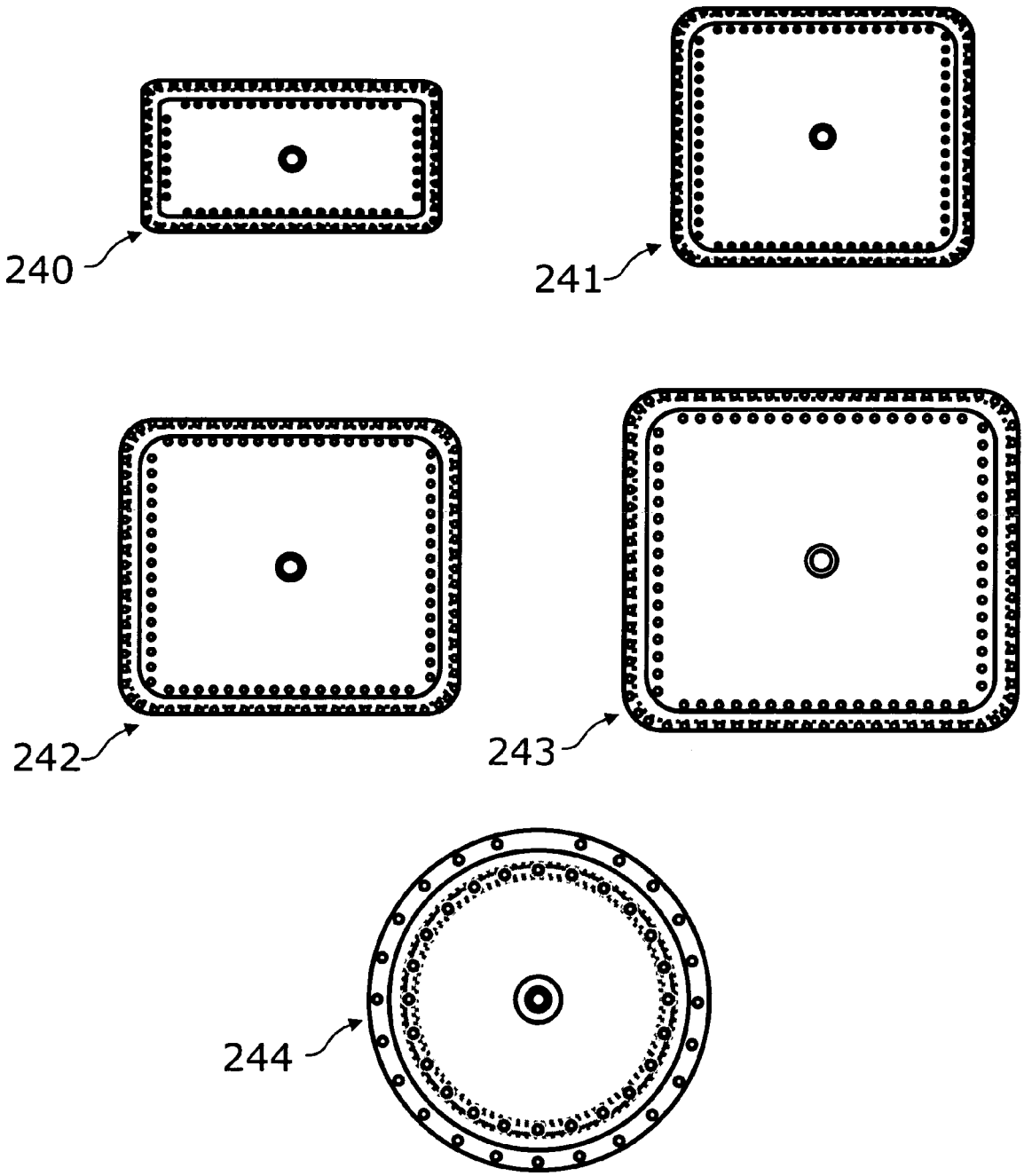
FIG. 34 illustrates several spring designs for the transducer of FIGS. 26-33.

It should be pointed out that although the springs in the above example are used to replace a wooden structure, the techniques described herein can be applied to construct springs using any material composition suitable for the constructing the transducer assembly. For example, in FIG. 32-34, plastic, fiberglass, carbon fiber/Kevlar, metal and other materials or combinations thereof may alternatively be used. The spring surfaces 222, 224 can be molded very much like the smaller springs 74, 78 discussed above with reference to FIGS. 1-25. The size and shapes of the springs can be different for different applications. For example in FIG. 34, the springs 240 that form a first panel may be 6"×12 " and the springs 241 in a second panel of a structure may be 10"×12 ". As another example, springs 242 in a first panel may be 16"×12" and the springs 243 in a corresponding second panel of a structure may be 16"×20". As yet another example, one or more springs 244 may exhibit a 16" circular diameter. These different sized allow the panels to be attached together to create several different products. Of course the specific sizes were given by way of illustration and not by way of limitation.

Figure 35:
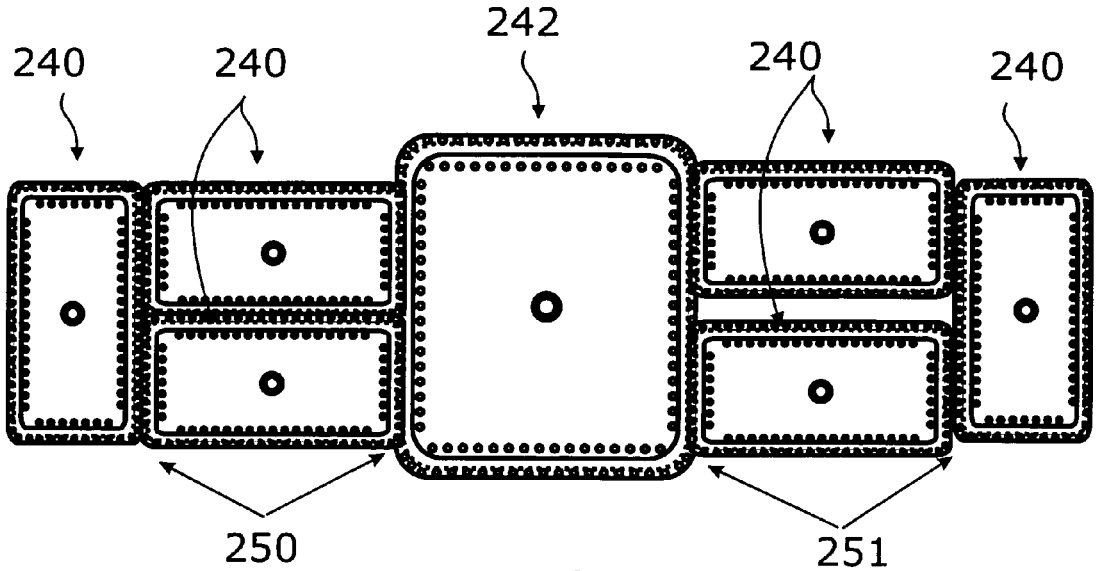
FIG. 35 is a top x-ray view of the transducers arranged integral to a reclining chair according to an embodiment of the present invention.
Figure 36:
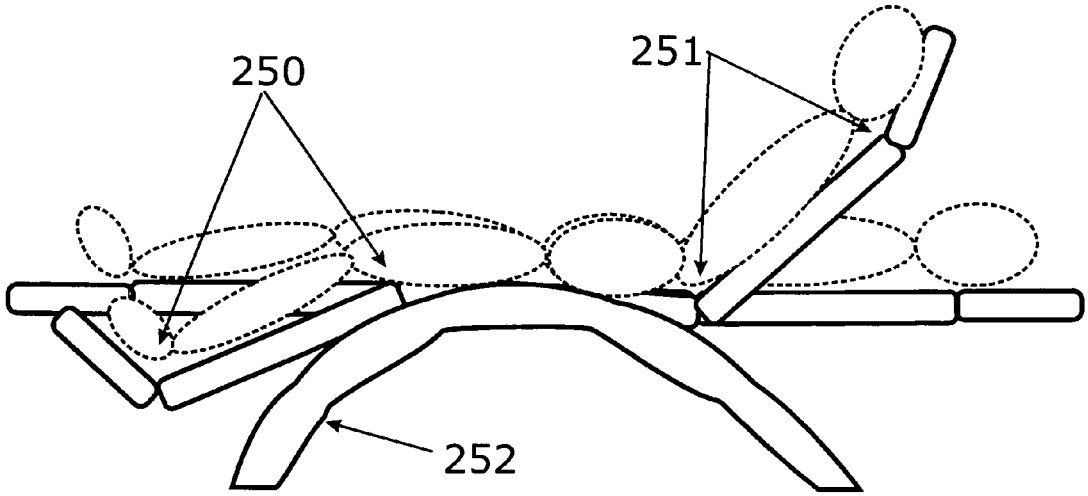
FIG. 36 is a side schematic view of the chair of FIG. 35.

It is also noted that the same general concepts described above can be applied to any other apparatus that includes a surface thereto. For example, the above described transducer assembly could replace a platform upon which one may sit or stand, etc. For example, in FIGS. 35 and 36, the surfaces that would typically be connected together in chair are replaced with transducer assembly panels. As such, transducers are incorporated into panels as described above with reference to FIGS. 26-34, which are connected together to create a chair that reclines. These panels are connect to a base 252 and have pivot points 250 and 251 that are controlled by electronic motors, electronic muscles or just a mechanical adjustment. The mechanical movement imparted to the chair can be computer controlled. The computer adds greater control to the vibrational aspects of the transducers, which allows the chair to simulate desired conditions. As such, the chair "breathes" in response to the computer control. For example, the chair may be used to create "electronic muscles", a floating effect along with the sound of air rushing, or a simulation of road surfaces and bumps along with frequencies of the actual sound of road on wheels, such as may be used in race training or flight simulation.

Figure 37:
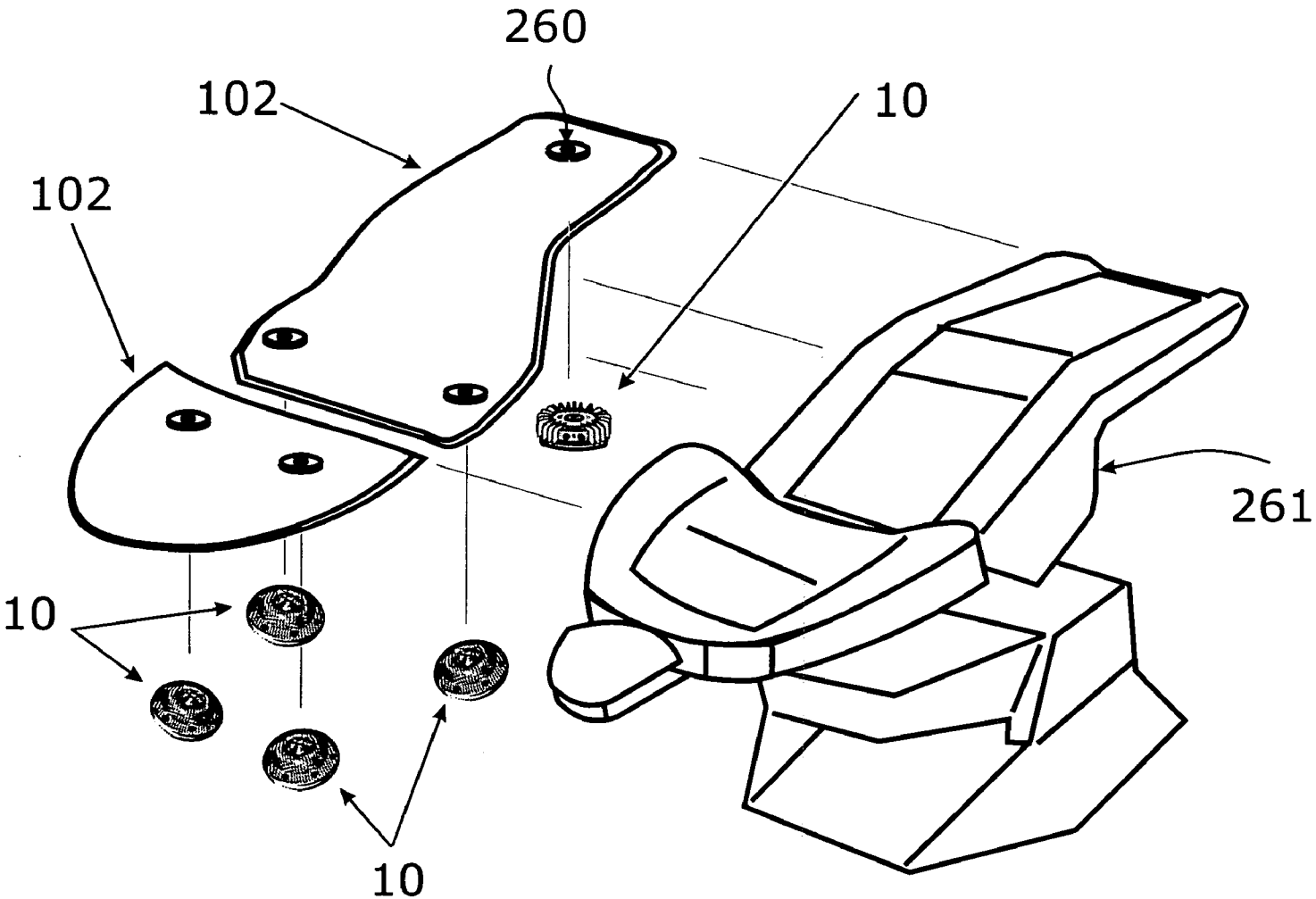
FIG. 37 is an illustration of incorporating transducers into the design of a dental chair according to an embodiment of the present invention.

The Dental Chair:

An example of implementing the above techniques is to incorporate the above transducer 10 and transducer techniques into a dental chair. Referring to FIG. 37, a plurality of transducers 10 are mounted to one or more surfaces 102 using mounting location attachments 260. The surfaces 102 and transducers 10 are then installed as the backrest and leg rest of a dental chair 261. As noted above, the present inventor has noted that shape elicits tone when the transducer 10 is coupled to a surface. As such, the backrest and leg rest surfaces 102 are provided with specific compositions and geometries that are sympathetic to the vibrational information transmitted by the transducers 10. A more detailed explanation of the shaping, material and construction of the surfaces 102 is explained below with reference to the sound chair.

Combinational Transducer Arrangements Generally:

The transducers 10 of the present invention, whether stand alone, mounted to a surface, or designed so as to be integral to the surface itself, can be excited by mono, stereo, or any combination of multi-channel systems. For example, 4.1, 5.1, 4.2, 2.2 and other custom audio mix combinations can be used. For example, in a two-way system, two or more transducers can be connected thereto, each transducer specifically designed to cover a specific frequency range and/or dynamics. Because of the inherent shortcomings of prior tactile transducers, the use of multi-channel systems has not been heretofore implemented.

These new configurations allow multiple programming possibilities for the interaction of the transducers in relationship to the surface. A person's perception can be divided into left brain and right brain inputs respectively. This left and right input multiplied by two can be used in stereo and also cross lateral. For example, activating the right leg first and then the left shoulder would be a cross lateral programmable movement. From there, circular movements, and random activating (to name a few) the transducers keeps the listener in a "new stimulus" mode of listening, known to prevent the listener from loosing the attention on the vibrations. This addition of multi-channel systems opens a new and expansive door to multiple patterns thus expanding the depth in patterned movement from just left to right or just different frequencies.

Figure 38:
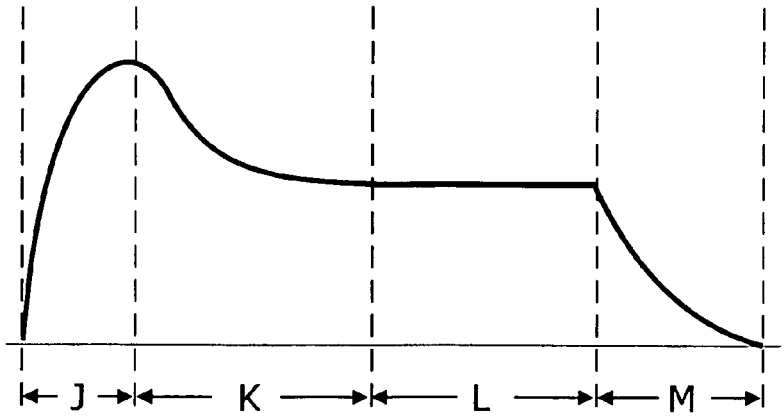
FIG. 38 is an attack, decay, sustain, release curve.

The transducers of the present invention may also be used in tactile crossover combinations. In other words, different envelope applications that include specific attack, decay, sustain, and/or release characteristics can be implemented. Referring to FIG. 38, a dynamics envelope shows the attack of a signal in segment J, the decay of the signal in segment K, the sustain of the signal in section L and the release of the signal in section M.

With the above in mind, a transducer 10 can be constructed that can keep up with the transient attack response of a given signal, but may not be able to carry the sustain segment of the signal. Such may be accomplished by incorporating a relatively stiff spring, such as a composition of carbon Kevlar, or by tightening the springs as discussed above. A second transducer 10 may be used to carry the sustain or release portion of the signal. Such a second transducer may be unable to suitably tract the transients of the attack of the signal however. The mechanics of the second type of transducer are loose and cannot stop the motion and carry the signal at the same time.

Figure 39:
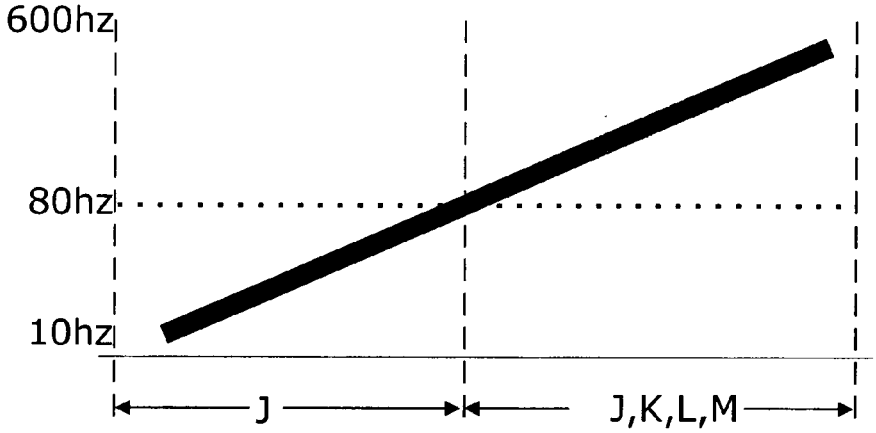
FIG. 39 is a chart illustrating frequency as a function of dynamics.
Figure 40:
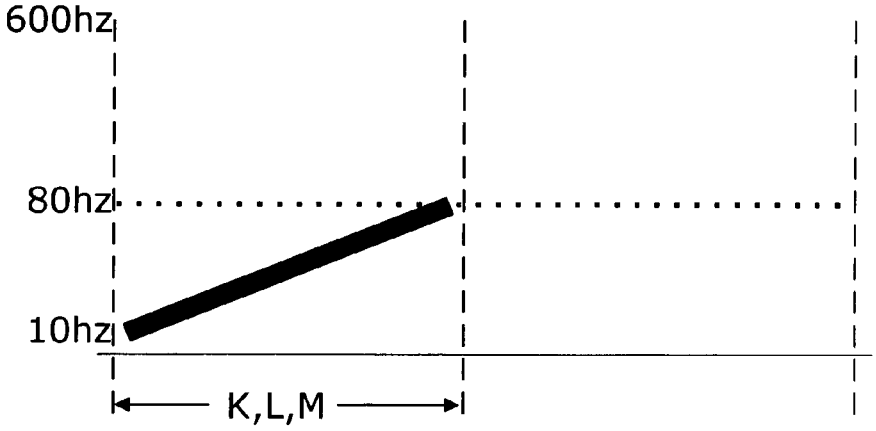
FIG. 40 is a chart illustrating frequency as a function of dynamics.

In FIG. 39 the chart shows one transducer able to attack segment J of the wave from approx. 15 hz to 80 hz and then have the ability to attack J, decay K, sustain L, and release M the area of frequencies 80 hz to 600 hz. So the first transducer works frequencies from 15 hz to 80 hz overlaps with the second transducer in FIG. 40, only having the ability to carry the wave relating to the decay K, sustain L, and release M in the area of 15 hz through 80 hz. This is much different then a regular audio crossover that cuts the signal where it crosses over. This type of crossover of dynamics is mostly created in the mechanical workings of each transducer. However, to keep the second transducer from overworking, a filter on the audio signal input prevents it from receiving frequencies above 80 hz.

Sound Chair:

As noted above, the vibrational information conveyed by the transducer 10 can be "tuned" by altering the size and surface contours on the springs to target specific frequency tones. As was seen above, existing surfaces can be integrated into transducer assemblies. Additionally, new structures can be created to take advantage of the principles of the present invention. By curving surfaces, both tension and pitch may be produced. Accordingly, the present invention may be incorporated into custom designed structures such as chairs and other devices.

Figure 41:
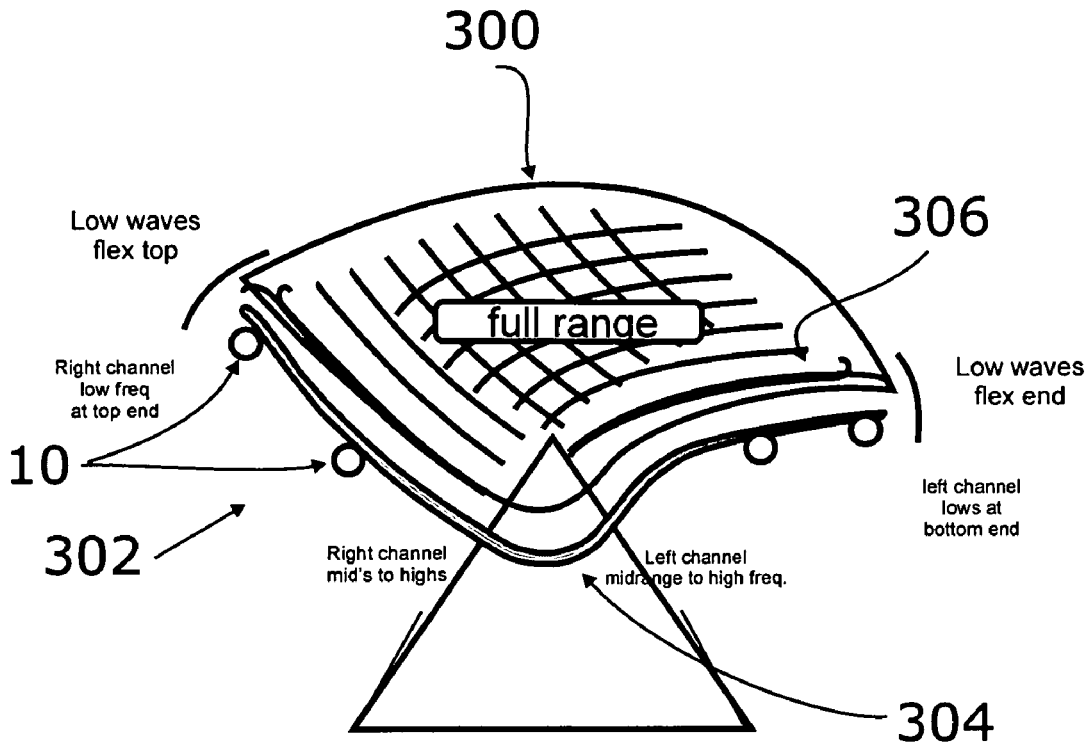
FIG. 41 is a side view of a chair according to an embodiment of the present invention.
Figure 42:
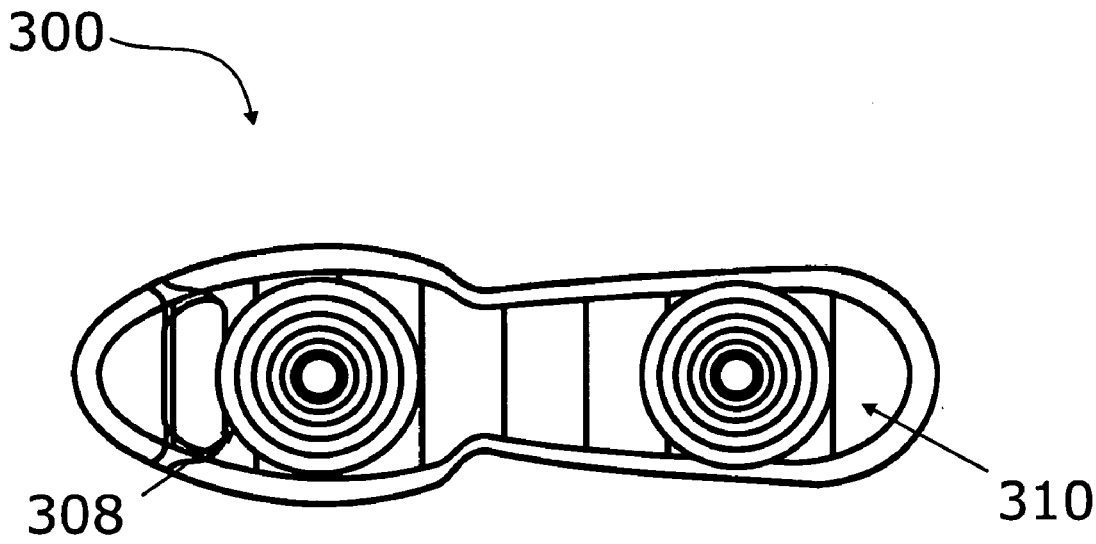
FIG. 42 is a schematic representation of the chair of FIG. 41 illustrating tonal centers of the chair.

The chair 300 according to an embodiment of the present invention includes a specific surface contour that promotes the transmission of vibratory information. As can be seen in FIG. 41, the shape of the chair 300 includes a gently angled back rest 302, a generally curved seat portion 304, and a slightly raised leg support 306. In this configuration, an occupant of the seat is reclined in a tilted back, restful position. Accordingly, the chair itself creates a relationship with the body of a person sitting therein. Referring briefly to FIG. 42, high tones resonate the upper portion 308 of the chair 300. Likewise, lower tones resonate the lower portion 310 of the chair 300. The resonant characteristics of the chair are independent of the origin of the energy applied thereto. That is, a relatively high tone applied to the lower portion 310 of the chair will resonate the upper portion 308 of the chair 300 and vice-versa. The construction of the chair 300 so as to resonate relatively higher tones in the upper (seat back) portion 308 of the chair 300 stem from studies that indicate that the relatively higher tones tend to resonate the upper part of the human body and relatively lower tones tend to resonate the lower part of the body.

Figure 43A:
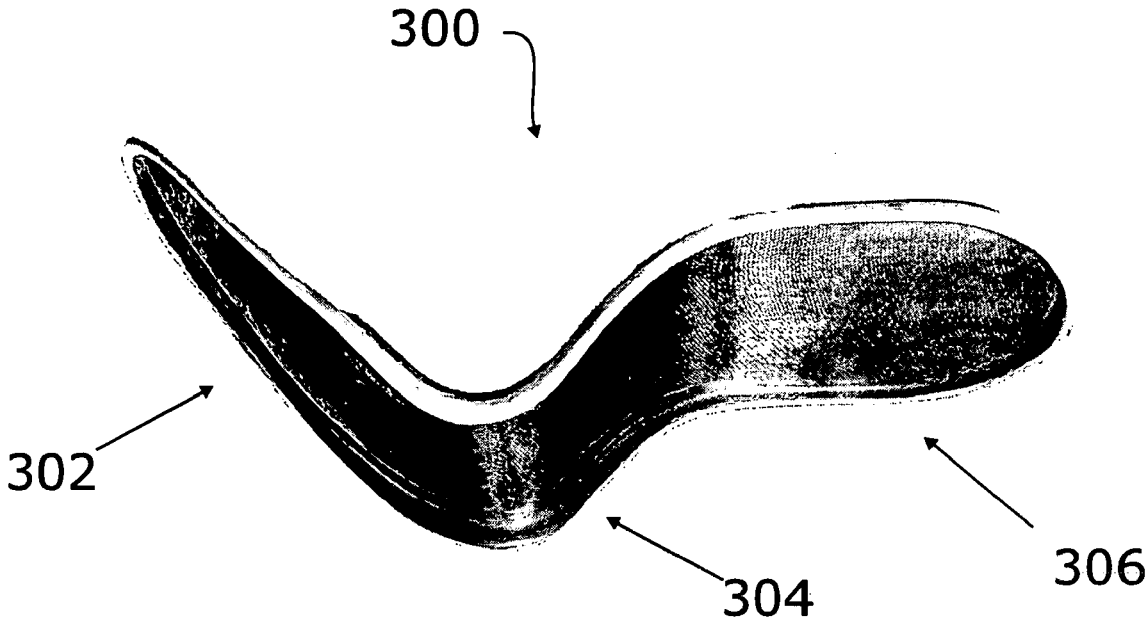
FIG. 43 is a side view of the chair of FIG. 41 illustrating how the chair itself behaves like a diaphragm.
Figure 43B:
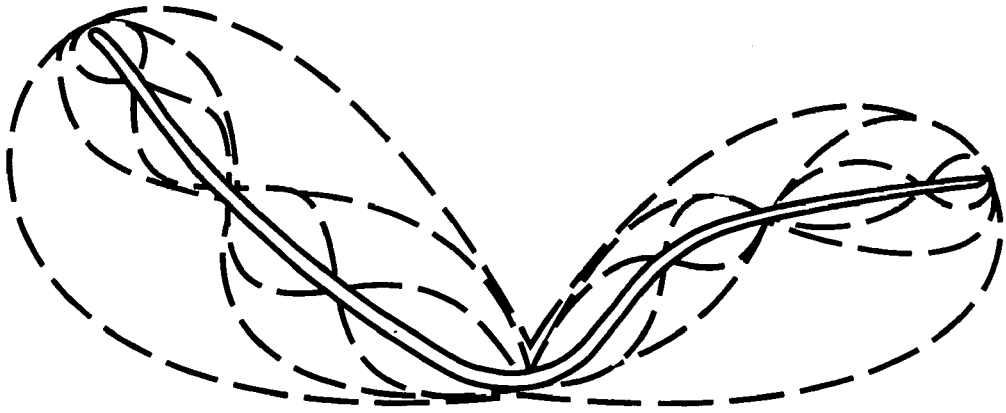

The resonant effect of the chair is particularly effective where the chair 300, including the back and seat, comprise a one-piece construction. For example, as best seen in FIGS. 41 and 43, the back and seat may be molded in a continuous piece from a composition comprising carbon fiber and Kevlar. The chair may also be constructed of any other moldable material or non-moldable material. However, performance may vary depending upon the desired selection of materials. The chair 300 defines a tonal surface that serves as a "highway" to transport vibration information. As such, the specific selection of materials will affect the quality of the chair to conduct the vibration information.

Referring back to FIG. 41, in practice, the chair 300 is held from the seat area, or general center of the chair 312. As the chair is excited with acoustic information, the chair actually breathes and acts like a spring itself, flexing in response to the information applied thereto. That is, the chair itself provides a spring effect, particularly in response to relatively low frequencies, at the outer ends (top of the back rest and bottom of the leg rest). The breathing effect is advantageous in that it has been found to allow lower amplitude signals applied thereto to produce comparable results for occupants of the chair of the present invention. For example, low frequency vibrations (in the one to twenty hertz range) can be reduced.

In one implementation, the chair includes four transducers 10 to reproduce a stereo (left and right) signal. A power amplifier(s) in the base thereof supplies the power to each transducer. The right channel is coupled to a low frequency transducer and a midrange frequency transducer coupled to the seat back of the chair. Correspondingly, the left channel includes a low frequency transducer and a midrange frequency transducer coupled to the leg rest. As pointed out above, even though the right channel low frequency transducer is coupled to the seat back, it will cause the leg rest to resonate. Correspondingly, although the left channel midrange transducer is coupled to the leg rest, the left channel transducer will still resonate the seat back.

Figure 44:
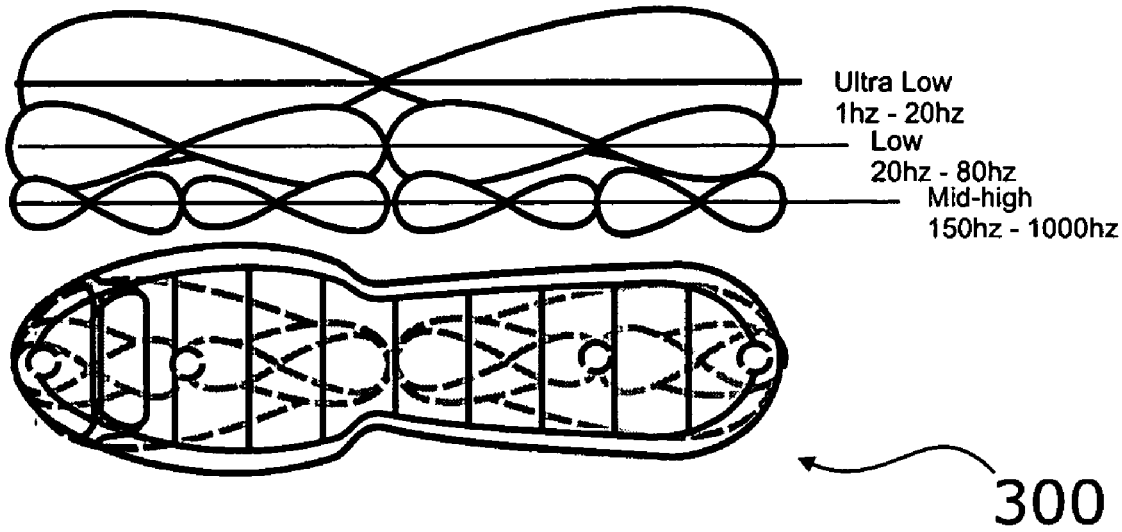
FIG. 44 is a schematic illustration of the chair of FIG. 41 illustrating frequency characteristics of the chair.
Figure 45:
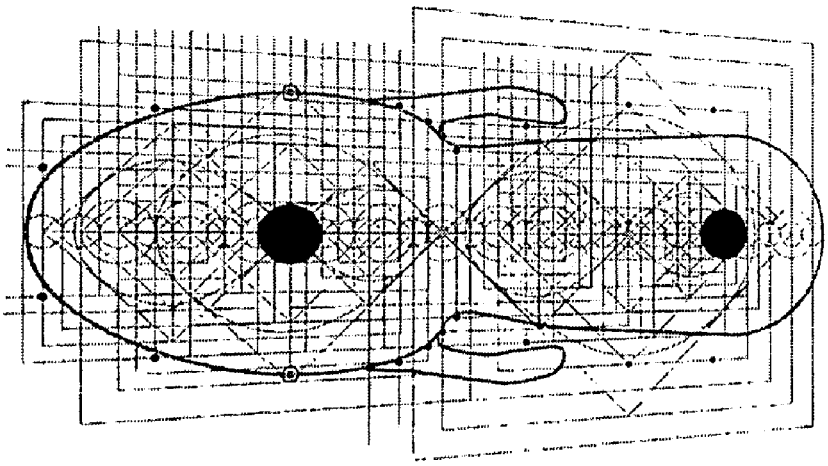
FIG. 45 is a top view of the chair of FIG. 41 illustrating the tonal centers of the chair.
Figure 46:
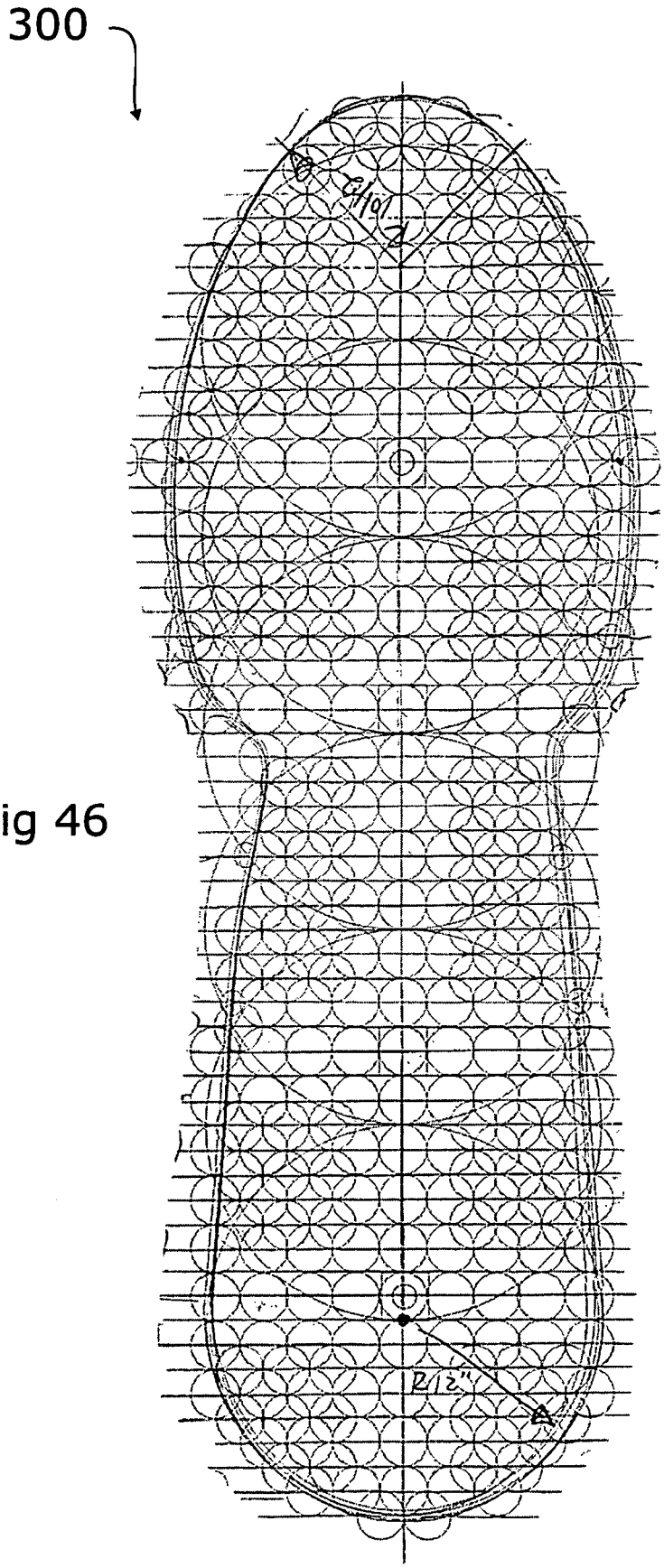
FIG. 46 is a schematic view of the chair laid out flat to illustrate the geometric proportions of the chair.
Figure 47:
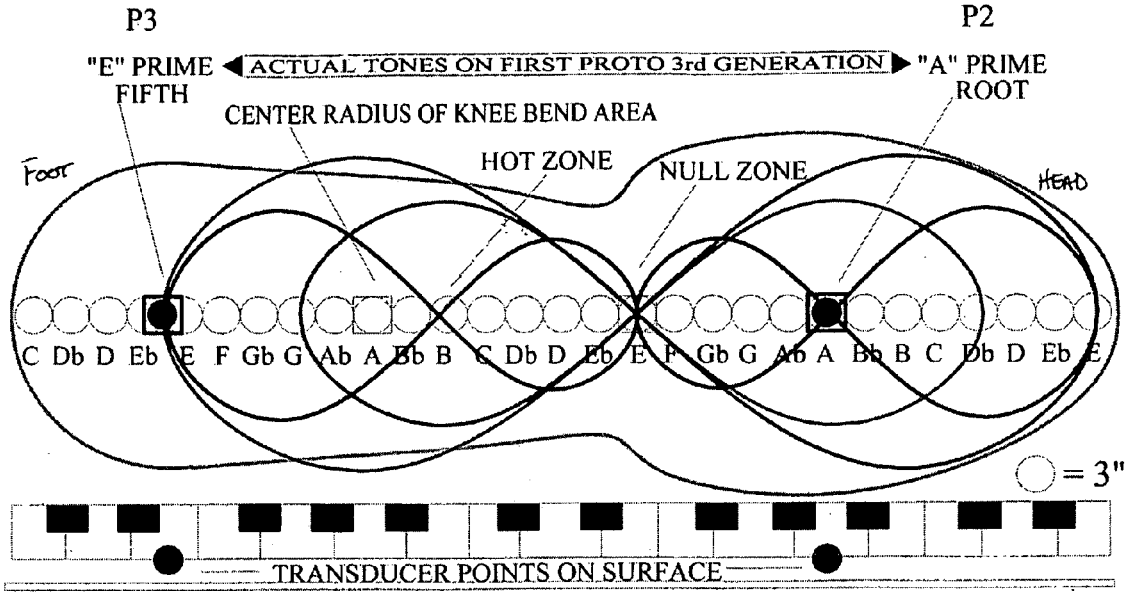
FIG. 47 is a schematic illustration showing how the chair is actually tuned to resonate at specific harmonic intervals.

Also, as suggested in FIGS. 44-46, it can be seen that the chair is geometrically proportioned. For example, as best seen in FIGS. 44 and 46, it can be seen that the chair 300 itself is designed based upon the Fibonacci sequence such that the shape of the chair is specifically tailored to transmit the vibrational information applied thereto. This allows the chair to be scaled, and allows the chair to be aligned with a broad frequency range, thus producing a generally quiet, clean and balanced sound response. Also, the one piece construction of the back rest, seat and leg support defines a monolithic structure that allows the specific design to be tailored to achieve desired (and often complex) dynamic interaction. Referring to FIG. 47, the geometry of the chair is laid so as to be flattened out over a piano keypad to illustrate the manner in which the Fibonacci based design affects the ability of the chair to transfer vibratory information. In the example shown, the chair is "tuned" to the key of A for illustrative purposes only. Any other key may be used. Comparatively, arrangements that simply mount typical transducers can "beat" against each other, resulting in generally sluggish response that may exhibit phase cancellation of certain tonal bands. Also, chairs constructed of separate panels will be less efficient at transferring vibrational information from one location to another across panels.

The chair 300 further allows specific targeting of vibrational information that is not otherwise possible. For example, by knowing the tonal surface design, audio signals can be recorded and played back through the chair to enhance the surface in predetermined ways to produce different types of responses. For example, where the upper and lower tonal centers of the chair are tuned, such as to a musical fifth as noted above in the discussion of the transducers, harmonics can be composed so as to work together and non-harmonic tones will beat against each other.

Figure 48:
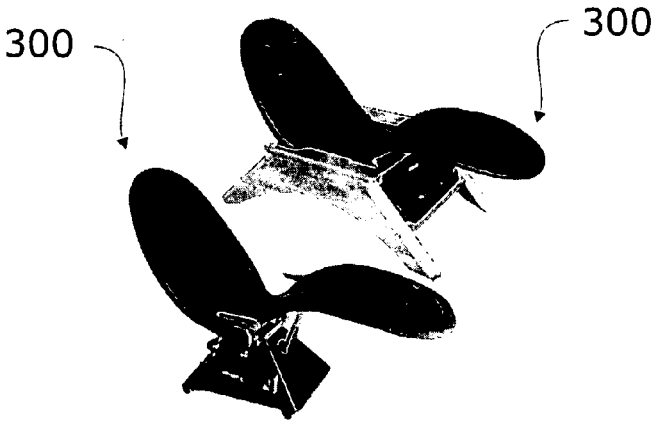
FIG. 48 is a photographic view of an embodiment of the chair shown in FIG. 41.

It should be emphasized herein that the back rest, seat, and leg rest not only provide the structural support for the occupant of the chair, but they also serve as a spring for the transducers to interact with, in addition to serving as a medium for conveying the vibration information. FIG. 48 illustrates an actual embodiment of the chair 300.

The present invention can also be incorporated into or combined with an electronic muscle by use of electroactive polymers, such as described in co-pending Provisional Application Ser. No. 60/625,611, entitled "Electronic Muscle Application For Tactile Delivery," filed Feb. 14, 2005, which is hereby incorporated by reference for all purposes.

Having described the invention in detail and by reference to preferred embodiments thereof, it will be apparent that modifications and variations are possible without departing from the scope of the invention defined in the appended claims. Indeed, although disclosed as being used with body-support surfaces such as chairs and tables, the present invention can also be incorporated into other body-contacting devices such as massage wands. As such, it will be understood by those skilled in the art that the present invention may be embodied in other specific forms without departing from the scope of the invention disclosed and that the examples and embodiments described herein are in all respects illustrative and not restrictive. Those skilled in the art of the present invention will recognize that other embodiments using the concepts described herein are also possible. Further, any reference to claim elements in the singular, for example, using the articles "a," "an," or "the" is not to be construed as limiting the element to the singular.

What is claimed is:

1. A transducer comprising:

an upper spring assembly having an upper spring;

a magnet assembly having a magnet positioned on a stud;

a main plate assembly having a main plate with an aperture;

a coil assembly having a first coil, a second coil, and an electrical power source attached to each coil; and a lower spring assembly having a lower spring, wherein:

the upper spring and the lower spring are comprised of surfaces and are secured at a peripheral region thereof to the main plate assembly;

the coil assembly is secured to the main plate so as to position the first coil and second coil adjacent opposite sides of the aperture and the electrical power source is attached to the first coil and the second coil so that the first and second coils are positioned in said a south-to-south configuration; and the stud of the magnet assembly is secured to the upper spring assembly and the lower spring assembly and suspends the magnet within the aperture and coil assembly.

2. The apparatus of claim 1, wherein the surfaces of the upper and lower springs include a profile with an outer portion radius and an inner portion radius.

3. The apparatus of claim 2, wherein the surfaces of the upper and lower springs include a nipple portion that is secured to the stud.

4. The apparatus of claim 1, wherein the surfaces of the upper and lower springs are made of carbon fiber composite.

5. The apparatus of claim 4, wherein the carbon fiber composite includes aramid fibers.

6. The apparatus of claim 1, wherein the surfaces of the upper and lower springs form a general appearance of a donut shape when secured to the main plate.

7. The apparatus of claim 6, wherein the surfaces of the upper and lower springs have a profile that incorporates at least two radii that are related to each other as being members of a Fibonacci sequence.

8. The apparatus of claim 1, further comprising mounting means associated with the main plate assembly.

9. The apparatus of claim 1, further comprising mounting means associated with the magnet assembly stud.

10. The apparatus of claim 8, wherein the surface of the upper spring further comprises a body support means.

11. The apparatus of claim 10, wherein said body support means is selected from the group consisting of chair panels, table panels, and floor panels.

12. The apparatus of claim 9, further comprising a resonating body support panel having a geometry based upon a Fibonacci sequence and said mounting means is attached to a location on the resonating body support panel associated with a tonal center.

13. The apparatus of claim 1, wherein the stud of the magnet assembly is secured to the upper spring assembly and the lower spring assembly with a resilient means for allowing the spring tension to be adjusted for tuning purposes.

14. The apparatus of claim 13, wherein the resilient means includes pliable o-rings on either side of the magnet on the stud.

15. The apparatus of claim 1, further comprising the main plate being formed of heat conductive material of sufficient surface area to provide a heat sink for said transducer.

16. A method of using the transducer of claim 1, comprising supplying an amplified audio source as the electrical power source for each coil; and driving the transducer in a range of 10 Hz-2 KHz.

17. The method of claim 16, further comprising:

selecting the audio source associated with stress reduction; and applying the audio source to a human body with the transducer.

18. The method of claim 17, further comprising applying the audio source to the human body by tactile contact of the transducer with the human body.

19. The method of claim 16, further comprising:

supplying the amplified audio source selected from the group consisting of mono, stereo, 4.1 multi-channel, 5.1 multi-channel, 4.2 multi-channel, 2.2 multi-channel, and combinations thereof.

* * * * *